US011173528B2

(12) United States Patent
Fujii et al.

(10) Patent No.: US 11,173,528 B2
(45) Date of Patent: Nov. 16, 2021

(54) ROLL CHANGING DEVICE

(71) Applicant: PRIMETALS TECHNOLOGIES JAPAN, LTD., Hiroshima (JP)

(72) Inventors: Katsumi Fujii, Hiroshima (JP); Michimasa Takagi, Hiroshima (JP); Fumihisa Shimaya, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 194 days.

(21) Appl. No.: 16/486,370

(22) PCT Filed: Jun. 16, 2017

(86) PCT No.: PCT/JP2017/022237
§ 371 (c)(1),
(2) Date: Aug. 15, 2019

(87) PCT Pub. No.: WO2018/229960
PCT Pub. Date: Dec. 20, 2018

(65) Prior Publication Data

US 2020/0238351 A1 Jul. 30, 2020

(51) Int. Cl.
*B21B 31/08* (2006.01)

(52) U.S. Cl.
CPC ..... *B21B 31/08* (2013.01)

(58) Field of Classification Search
CPC ..... B32B 31/103; B21B 31/08; B21B 31/10
(Continued)

(56) References Cited

U.S. PATENT DOCUMENTS 3,699,796 A * 10/1972 Eibe ..... B21B 31/106 72/239
4,074,558 A * 2/1978 Pim ..... B21B 31/103 72/239
(Continued)

FOREIGN PATENT DOCUMENTS

DE 3042445 A1 * 5/1982 ..... B21B 31/103
JP 56033108 A * 4/1981 ..... B21B 35/148
(Continued)

OTHER PUBLICATIONS

First Examination Report (FER) dated Aug. 5, 2020 issued to the corresponding Indian Application No. 201917039100.
(Continued)

*Primary Examiner* — Adam J Eiseman
*Assistant Examiner* — P Derek Pressley
(74) *Attorney, Agent, or Firm* — Birch, Stewart, Kolasch & Birch, LLP.

(57) ABSTRACT

Changing rolls in rolling equipment is performed more efficiently. For this purpose, a roll changing device (12) for changing a pair of top and bottom work rolls (21) provided in a rolling mill (11) for rolling a strip to be passed therethrough includes: a work roll holding unit (51) holding the pair of top and bottom work rolls (21) in an attachable/detachable manner and capable of moving the work rolls (21) in a threading direction; a roll holding device (31) including the work roll holding unit (51) and capable of moving in a roll axis direction relative to the rolling mill (11) in a state of holding the work rolls (21) by using the work roll holding unit (51); and a work roll transfer device (32) capable of moving in a direction intersecting with a moving path of the roll holding device (31) and capable of mounting the work rolls (21).

9 Claims, 18 Drawing Sheets

(58) Field of Classification Search
USPC ..... 72/239, 238, 237
See application file for complete search history.

(56) References Cited

U.S. PATENT DOCUMENTS

| | | | | |
|---|---|---|---|---|
| 6,408,667 | B1 | 6/2002 | de Jesus, Jr. | |
| 6,763,565 | B2 | 7/2004 | Mukaigawa et al. | |
| 2002/0078728 | A1 * | 6/2002 | Mukaigawa | B21B 31/103 72/239 |
| 2005/0138982 | A1 | 6/2005 | Berendes et al. | |

FOREIGN PATENT DOCUMENTS

| | | | | |
|---|---|---|---|---|
| JP | 2-30315 | A | 1/1990 | |
| JP | 8-32336 | B2 | 3/1996 | |
| KR | 10-2004-0105848 | A | 12/2004 | |
| KR | 100879737 | B1 * | 1/2009 | B21B 35/148 |
| KR | 10-2016-0139698 | A | 12/2016 | |
| KR | 20160139698 | A * | 12/2016 | |
| WO | WO-2018119549 | A1 * | 7/2018 | B22D 11/0682 |

OTHER PUBLICATIONS

Korean Office Action dated Sep. 25, 2020 for Application No. 10-2019-7026276 with an English translation.

* cited by examiner

ROLL CHANGING DEVICE

TECHNICAL FIELD

This invention relates to a roll changing device for changing rolls for a rolling mill.

BACKGROUND

The rolling mill is equipped with rolling mill rolls for rolling a strip which is a material to be rolled. For example, a four-high rolling mill is equipped with a pair of top and bottom work rolls and a pair of top and bottom back up rolls for supporting this pair of top and bottom work rolls; and a six-high rolling mill is equipped with a pair of top and bottom work rolls, a pair of top and bottom intermediate rolls for supporting this pair of top and bottom work rolls, and a pair of top and bottom back up rolls for supporting this pair of top and bottom intermediate rolls.

Since the rolling mill rolls become worn and deteriorate due to rolling of strips, rolling equipment may sometimes include a roll changing device for changing the rolling mill rolls (see, for example, Patent Document 1). As the rolling mill rolls in the rolling mill are changed by the roll changing device, it is possible to maintain, for example, good surface quality and shape of the strip which is rolled by the rolling mill.

CITATION LIST

Patent Literature

Patent Document 1: Japanese Examined Patent Publication (Kokoku) No. H08-32336

SUMMARY

Technical Problem

In recent years, the diameter of a work roll which is one of the rolling mill rolls has been reduced and rolling is performed high reduction, so that particularly the work roll(s) tends to easily become worn and deteriorate. Accordingly, the rolls such as the work rolls are frequently changed in the rolling equipment.

Since the rolls such as the work rolls are changed by stopping the rolling operation by the rolling mill, this leads to degradation of an operation rate and production efficiency of the rolling equipment. Therefore, there is a demand for more efficient change of the rolls in the rolling equipment.

The present invention was devised in light of the above-described problems and it is an object of the invention to change the rolls in the rolling equipment more efficiently.

Solution to Problem

A roll changing device according to the present invention to solve the above-described problem is a roll changing device for changing a pair of top and bottom work rolls provided in a rolling mill for rolling a strip to be passed therethrough, wherein the roll changing device includes: a work roll holding unit holding the pair of top and bottom work rolls in an attachable/detachable manner and capable of moving the held work rolls in a threading direction; a roll holding device including the work roll holding unit and capable of moving in a roll axis direction relative to the rolling mill in a state of holding the work rolls by using the work roll holding unit; and a work roll transfer device capable of moving in a direction intersecting with a moving path of the roll holding device and capable of mounting the work rolls.

Advantageous Effects

The roll changing device according to the present invention can change the rolls in the rolling equipment more efficiently.

DETAILED DESCRIPTION

Embodiments of a roll changing device according to the present invention will now be described in detail with reference to the accompanying drawings. Incidentally, an embodiment which will be described below is rolling equipment equipped with a four-high rolling mill provided with a pair of top and bottom work rolls and a pair of top and bottom back up rolls to which the roll changing device according to the present invention is applied. It is a matter of course that the present invention is not limited to the following embodiment and, for example, the roll changing device according to the present invention may be applied to rolling equipment equipped with various multi rolls mills such as a six-high rolling mill including a pair of top and bottom work rolls, a pair of top and bottom intermediate rolls, and a pair of top and bottom back up rolls; and needless to say, various kinds of changes can be made within the range not departing from the gist of the present invention.

Embodiment 1

The configuration of rolling equipment equipped with a roll changing device according to Embodiment 1 of the present invention will be explained below with reference to FIG. 1A to FIG. 10.

<Relation Between Rolling Mill and Work Rolls>

Figure 1A:
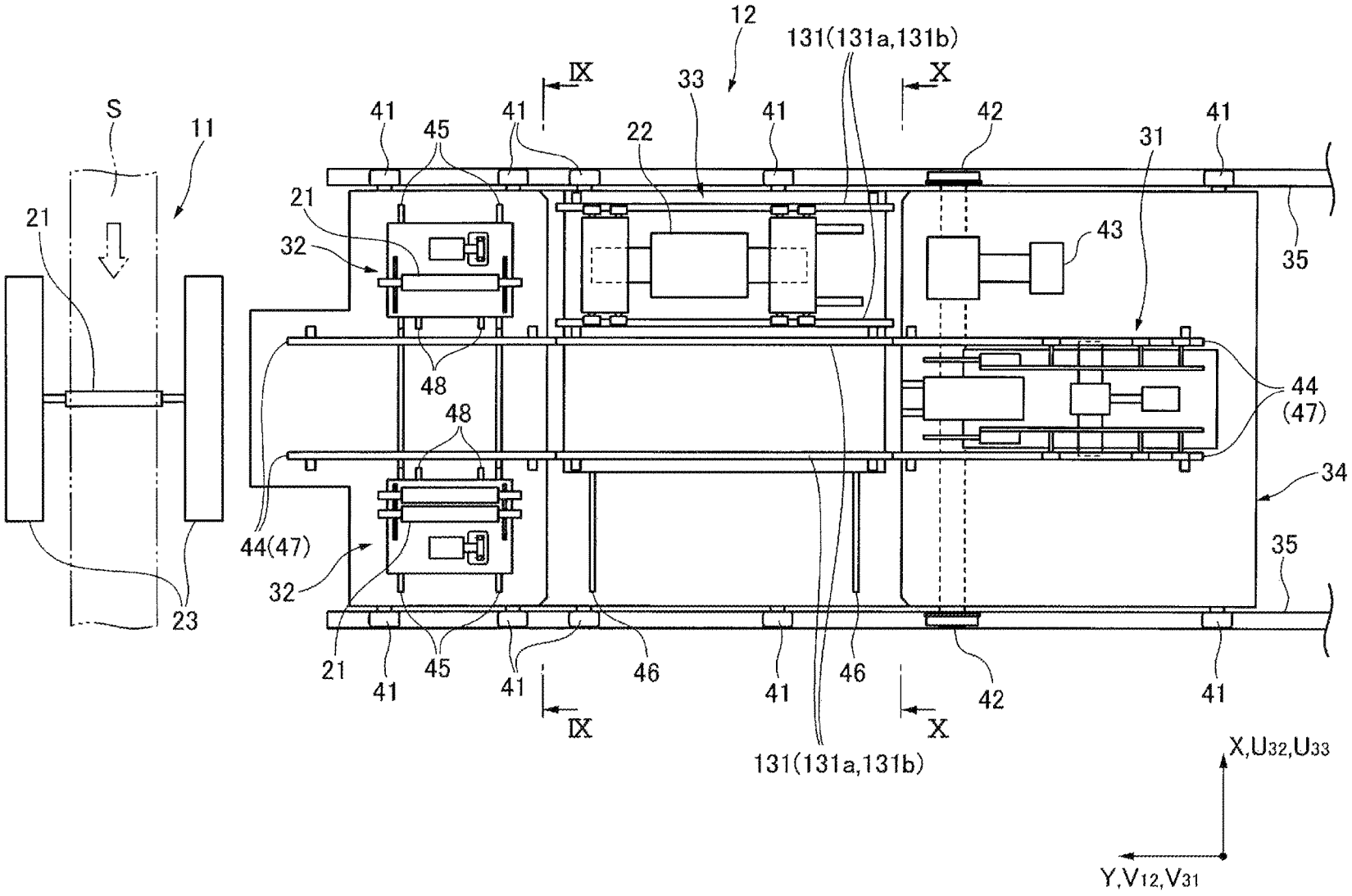
FIG. 1A is an explanatory drawing (plan view) illustrating rolling equipment including a roll changing device according to Embodiment 1.
Figure 3A:
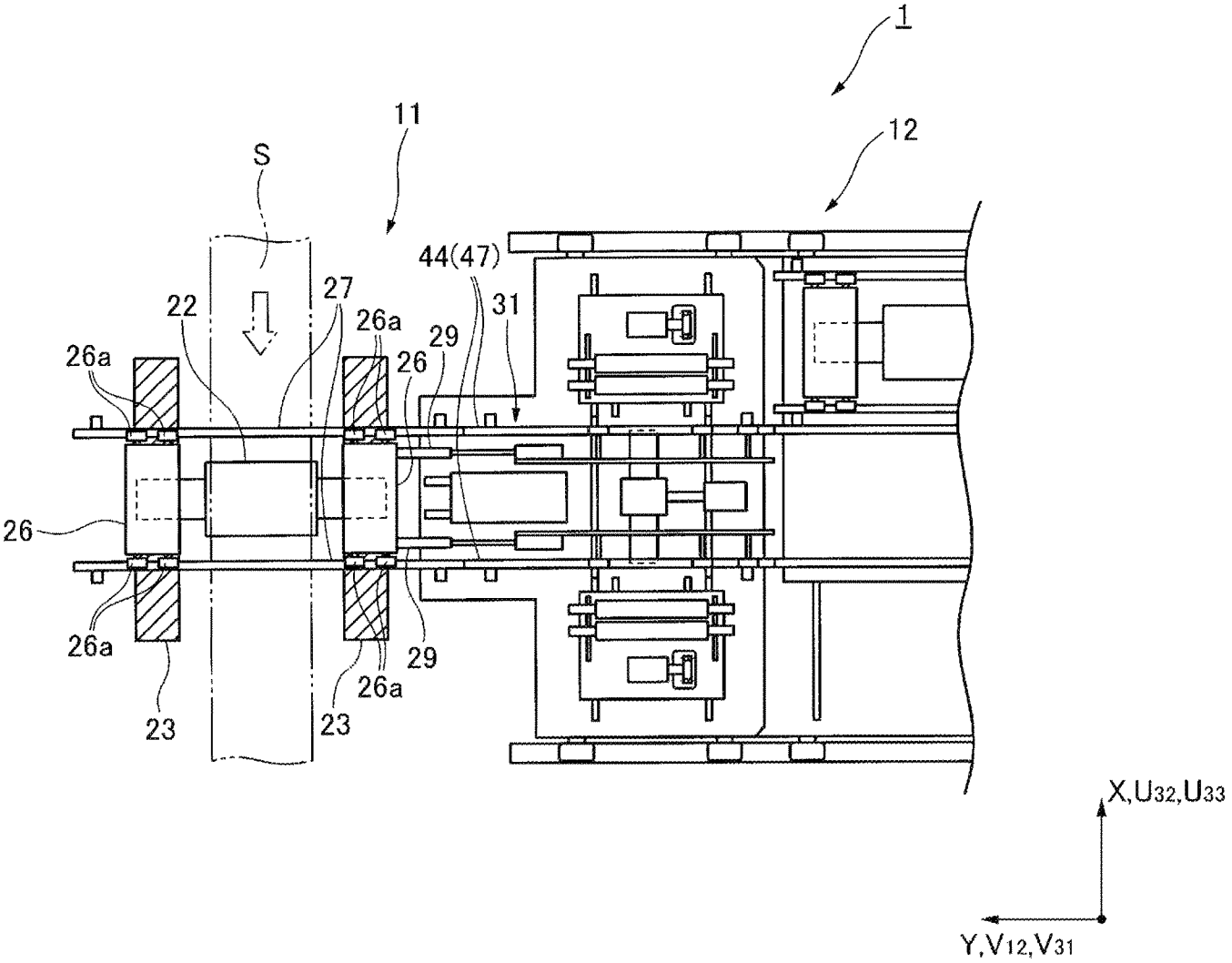
FIG. 3A is an explanatory drawing (fragmentary detailed view of FIG. 1A) illustrating a back up roll change operation by the roll changing device according to Embodiment 1.

Rolling equipment 1 is equipped with a rolling mill 11 for rolling a strip S to be passed through it as illustrated in FIG. 1A and FIG. 3A. Under this circumstance, the rolling mill 11 is a four-high rolling mill provided with one pair of top and bottom work rolls 21, which are placed on opposite sides of the strip S, and one pair of top and bottom back up rolls 22 for supporting the one pair of top and bottom work rolls 21.

Figure 2A:
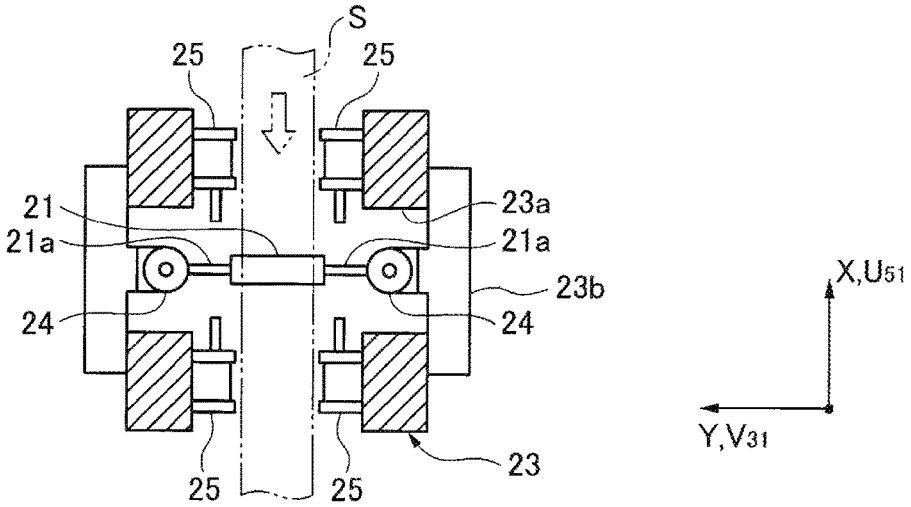
FIG. 2A is an explanatory drawing (plan view) illustrating a rolling mill in the rolling equipment including the roll changing device according to Embodiment 1.

A housing 23 which is an outer shell of the rolling mill 11 includes, as illustrated in FIG. 2A, an window 23*a* for maintenance such as change of rolls and an opening/closing door 23*b* capable of blocking this window 23*a*.

The pair of top and bottom work rolls 21 is not provided with any roll chock and the rolling mill 11 is provided with: a support roller (first roll support device) 24 which directly supports the one pair of top and bottom work rolls 21 and maintains them at a rolling position (the position capable of rolling the strip S) in a state where the opening/closing door 23*b* is closed (a closed door state); and support jacks (second roll support device) 25 which directly support the one pair of top and bottom work rolls 21 and maintain them at the rolling position in a state where the opening/closing door 23*b* is opened (an opened door state).

The support roller 24 is located inside the housing 23 (the opening/closing door 23*b*) and retains the one pair of top and bottom work rolls 21 at the rolling position by supporting both ends (shaft ends) 21*a* of the one pair of top and bottom work rolls 21 along a roll axis direction (which is a Y-axis direction, that is, a crosswise direction in FIG. 2A) in the closed door state (at the time of rolling by the rolling mill 11).

Figure 2B:
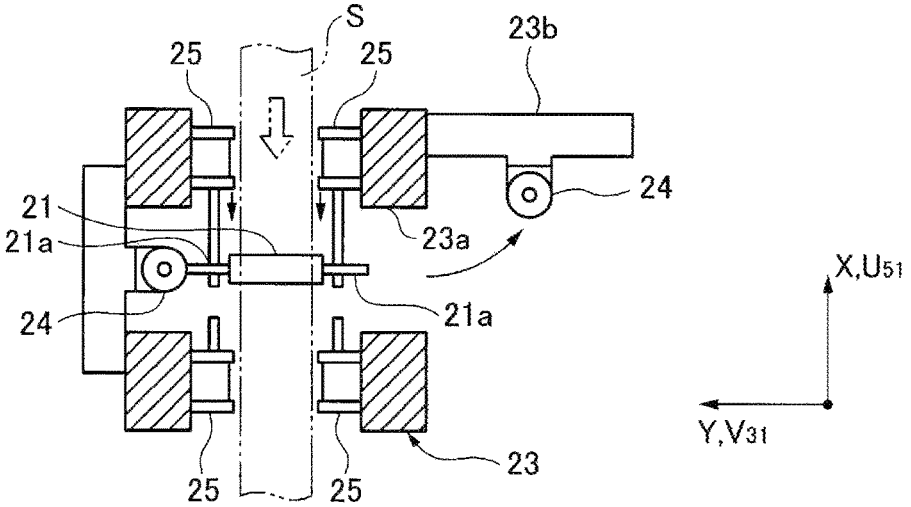
FIG. 2B is an explanatory drawing (corresponding to FIG. 2A) illustrating the work roll change operation by the roll changing device according to Embodiment 1.

The support jacks 25: are located in a threading direction (which is an X-axis direction, that is, a vertical direction in FIG. 2A) within the housing 23 so that the support jacks 25 can expand or contract; and retain the one pair of top and bottom work rolls 21 at the rolling position by supporting the axial-direction ends 21*a* of the one pair of top and bottom work rolls 21 with top ends of the extended support jacks 25 in the opened door state (at the time of change of the rolls of the rolling mill 11) (see FIG. 2B).

Figure 2C:
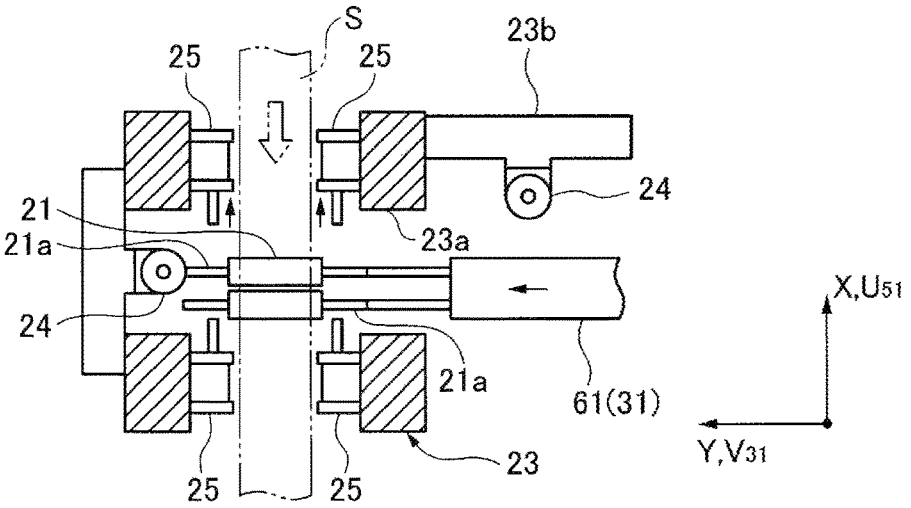
FIG. 2C is an explanatory drawing (corresponding to FIG. 2A) illustrating the work roll change operation by the roll changing device according to Embodiment 1.
Figure 2D:
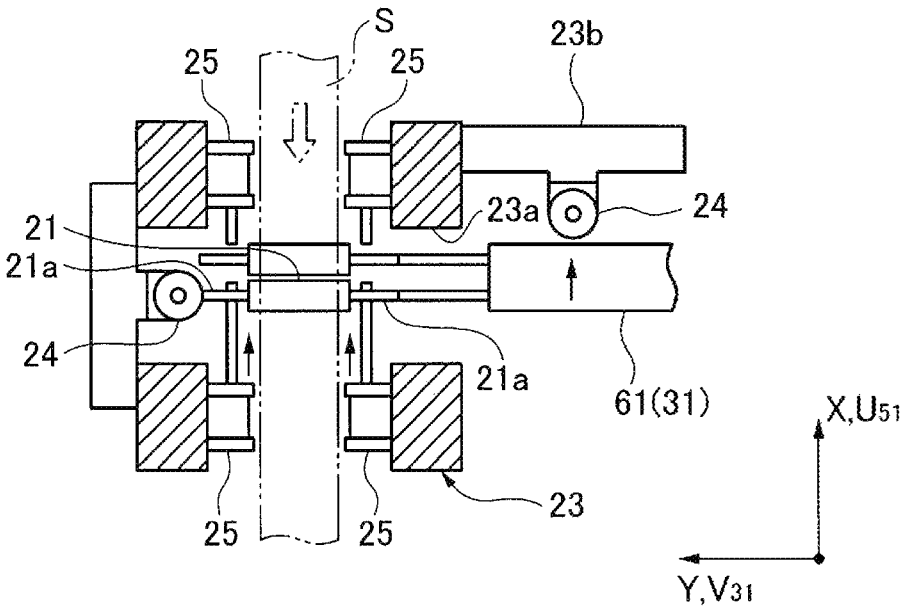
FIG. 2D is an explanatory drawing (corresponding to FIG. 2A) illustrating the work roll change operation by the roll changing device according to Embodiment 1.
Figure 2E:
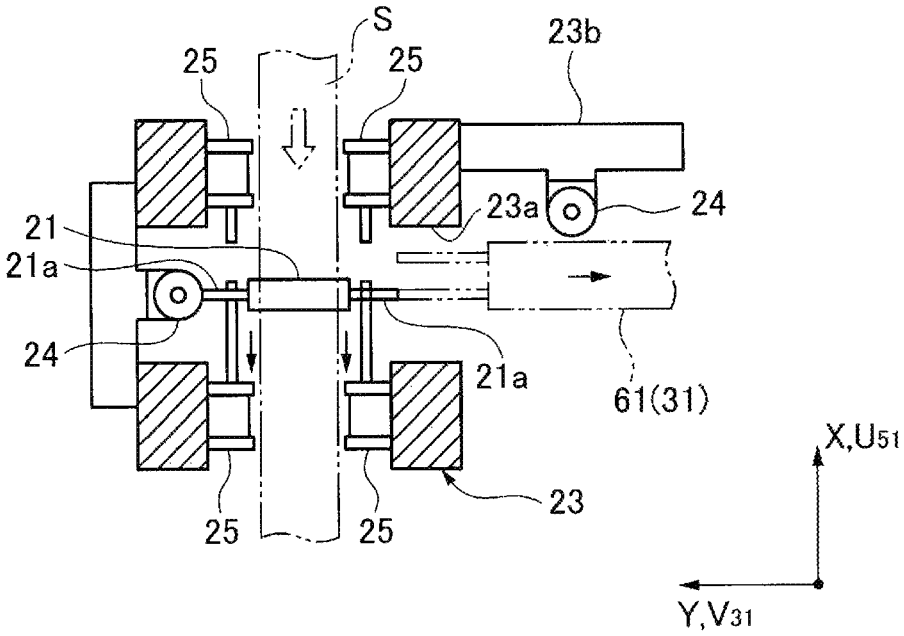
FIG. 2E is an explanatory drawing (corresponding to FIG. 2A) illustrating the work roll change operation by the roll changing device according to Embodiment 1.

Incidentally, the support jacks 25 are provided respectively on the upstream side in the threading direction (the top side in FIG. 2A) and the downstream side in the threading direction (the bottom side in FIG. 2A) of the one pair of top and bottom work rolls 21 and the one pair of top and bottom work rolls 21 is held by the support jacks 25 located at either the upstream side in the threading direction or the downstream side in the threading direction (see FIG. 2B and FIG. 2E).

<Relation Between Rolling Mill and Back Up Rolls>

The back up roll 22 is provided with roll chocks 26 as illustrated in FIG. 3A and each of these roll chocks 26 is provided with a traveling roll 26*a* supported on support rails 27 placed in the rolling mill 11. The support rails 27 are placed to extend in the roll axis direction (the crosswise direction in FIG. 3A) inside and outside the rolling mill 11 and the back up rolls 22 are maintained at the rolling position on the support rails 27 and can be moved along the support rails 27 (or can be carried into or out of the rolling mill 11).

Incidentally, the roll chock 26 for the back up rolls 22 is provided with a latch member 29 for changing (or moving) the relevant back up roll 22 at the time of the roll change by the roll changing device 12 described later. Each latch member 29 protrudes from the roll chock 26 at one side in the axial direction (the right side in FIG. 3A) towards that one side in the axial direction and a hook part 29*a* (see FIG. 5A) is formed at its top end; and a plurality of latch members 29 (two latch members 29 in this embodiment) are provided and separated from each other in the threading direction of the roll chock 26 (the vertical direction in FIG. 3A).

Figure 5A:
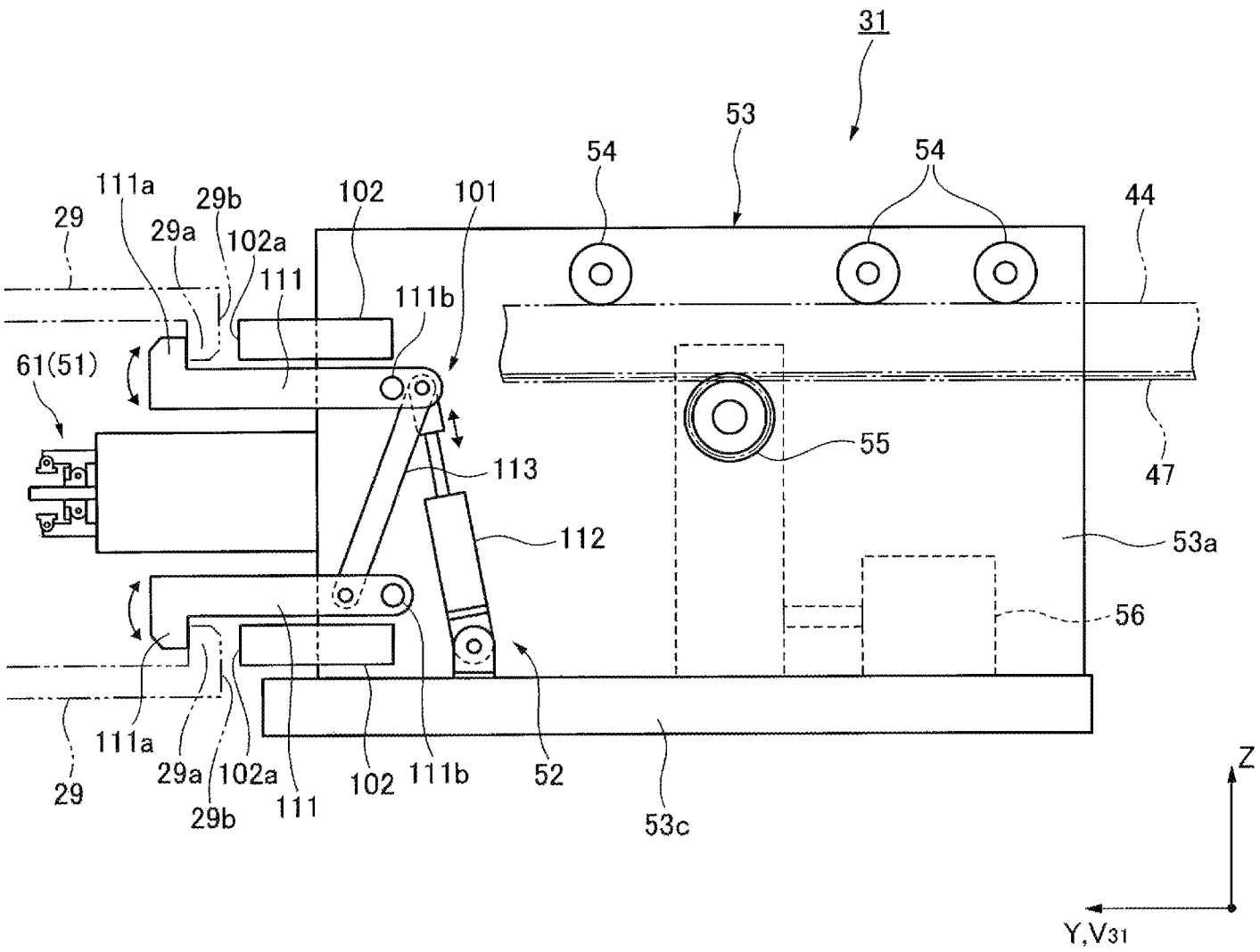
FIG. 5A is a side view (a view as seen from arrow V in FIG. 4) illustrating the push puller device in the roll changing device according to Embodiment 1.

Under this circumstance, the hook parts 29*a* of the latch members 29 provided on the roll chocks 26 for the one pair of top and bottom back up rolls 22 are placed opposite to each other (see FIG. 5A). Specifically speaking, each hook part 29*a* of the two latch members 29 provided on the roll chocks 26 for the back up rolls 22 at the bottom side in the vertical direction (the Z-axis direction) is shaped to protrude upwards in the vertical direction and each hook part 29*a* of the two latch members 29 provided on the roll chocks 26 for the back up rolls 22 at the top side in the vertical direction is shaped to protrude downwards in the vertical direction.

<Overall Configuration of Roll Changing Device

The rolling equipment 1 is equipped with a roll changing device 12 capable of changing the work rolls 21 and the back up rolls 22 in the rolling mill 11 as illustrated in FIG. 1A. The roll changing device 12 can simultaneously change one pair of top and bottom work rolls 21 in the rolling mill 11 and can simultaneously change one pair of top and bottom back up rolls 22 in the rolling mill 11.

The roll changing device 12 is provided with: a push puller device 31 capable of holding the work rolls 21 and the back up rolls 22, respectively, in the rolling mill 11; a work roll transfer device 32 capable of mounting the work rolls 21; a back up roll transfer device 33 capable of mounting the back up rolls 22; and a device moving carriage 34 which includes (or is equipped with) the push puller device 31, the work roll transfer device 32, and the back up roll transfer device 33 in a movable manner and can move them in the roll axis direction relative to the rolling mill 11.

Referring to FIG. 1A, the device moving carriage 34 is provided with: traveling wheels 41 and drive wheels 42 which are supported on device moving rails 35 placed over a floor face; and a device moving motor 43 for driving the rotation of the drive wheels 42. The device moving rails 35 extend laterally to the rolling mill 11 (on the right side in FIG. 1A) in a direction parallel to the roll axis direction (a $V_{12}$-axis direction parallel to the Y-axis) and the device moving carriage 34 (the roll changing device 12) is caused to travel in the $V_{12}$-axis direction along the device moving rails 35 by driving the device moving motor 43 and is thereby moved closer to or away from the rolling mill 11.

Furthermore, the device moving carriage 34 is provided with: first rails 44 for causing the one pair of top and bottom back up rolls 22 and the push puller device 31 to travel (or move) on the device moving carriage 34; second rails 45 for causing the work roll transfer device 32 to travel (or move); and third rails 46 for causing the back up roll transfer device 33 to travel (or move). The device moving carriage 34 is further provided with: first rack gears 47 for causing the push puller device 31 to travel (or move); and second rack gears 48 for causing the work roll transfer device 32 to travel (or move).

Figure 9:
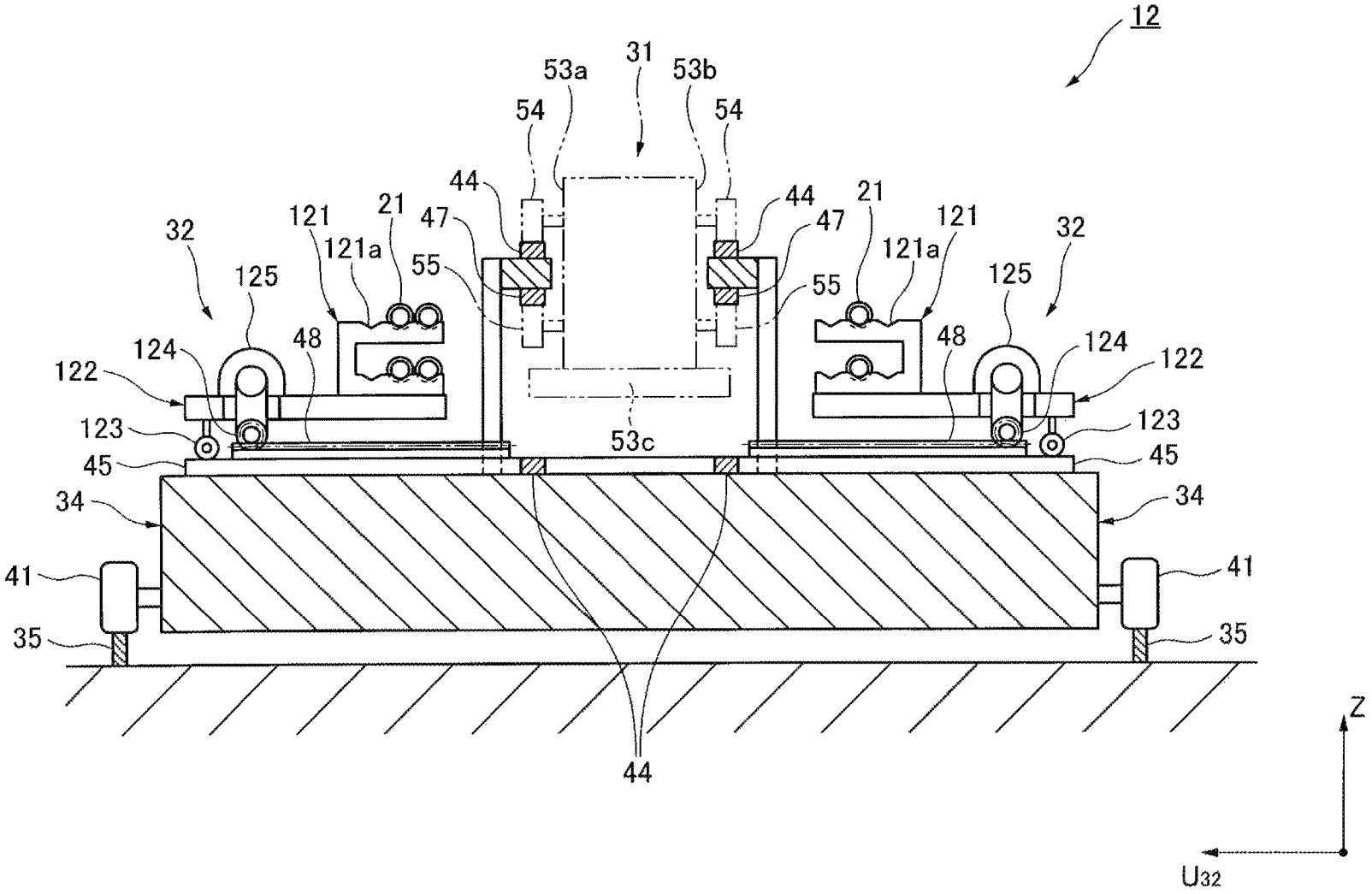
FIG. 9 is a fragmentary sectional view (a sectional view taken along arrows IX-IX in FIG. 1) illustrating the roll changing device according to Embodiment 1.

Referring to FIG. 1A, FIG. 3A, and FIG. 9, the first rails 44 are connected consecutively to the support rails 27 and two first rails 44 are located and separated from each other in the vertical direction so that they correspond to the one pair of top and bottom back up rolls 22, respectively; and the first rails 44 extend in a direction parallel to the device moving rails 35 (a $V_{31}$-axis direction parallel to the $V_{12}$-axis). The pair of top and bottom back up rolls 22 is designed so that the back up rolls 22 are supported respectively by the first rails 44 located at the top side in the vertical direction and the bottom side in the vertical direction. Accordingly, the one pair of top and bottom back up rolls 22 is caused to travel on the device moving carriage 34 in the $V_{31}$-axis direction along the first rails 44.

Furthermore, the first rack gears 47 are provided on the back side of the first rails 44 located at the top side in the vertical direction and extend in the same direction as the first rails 44. The push puller device 31 is designed to be supported by the first rails 44 at the top side in the vertical direction. Accordingly, the push puller device 31 is caused to travel on the device moving carriage 34 in the $V_{31}$-axis direction along the first rails 44.

Under this circumstance, the first rails 44 and the first rack gears 47 are split in a movement direction (the $V_{31}$-axis direction) of the one pair of top and bottom back up rolls 22 and the push puller device 31 and the back up roll transfer device 33 is positioned between the split first rails 44, so that the back up roll transfer device 33 functions as part of the rails (and the rack gears) on which the one pair of top and bottom back up rolls 22 and the push puller device 31 travel (the details will be described later).

Referring to 1A and FIG. 9, the second rails 45 for causing the work roll transfer device 32 to travel extend in a direction intersecting with the first rails 44 (a direction intersecting at 90° in this embodiment, that is, a $U_{32}$-axis direction perpendicular to the $V_{31}$-axis) and the second rack gears 48 extend in the same direction as that of the second rails 45 (the $U_{32}$-axis direction). Accordingly, the work roll transfer device 32 is caused to travel on the device moving carriage 34 in the $U_{32}$-axis direction along the second rails 45.

Figure 10:
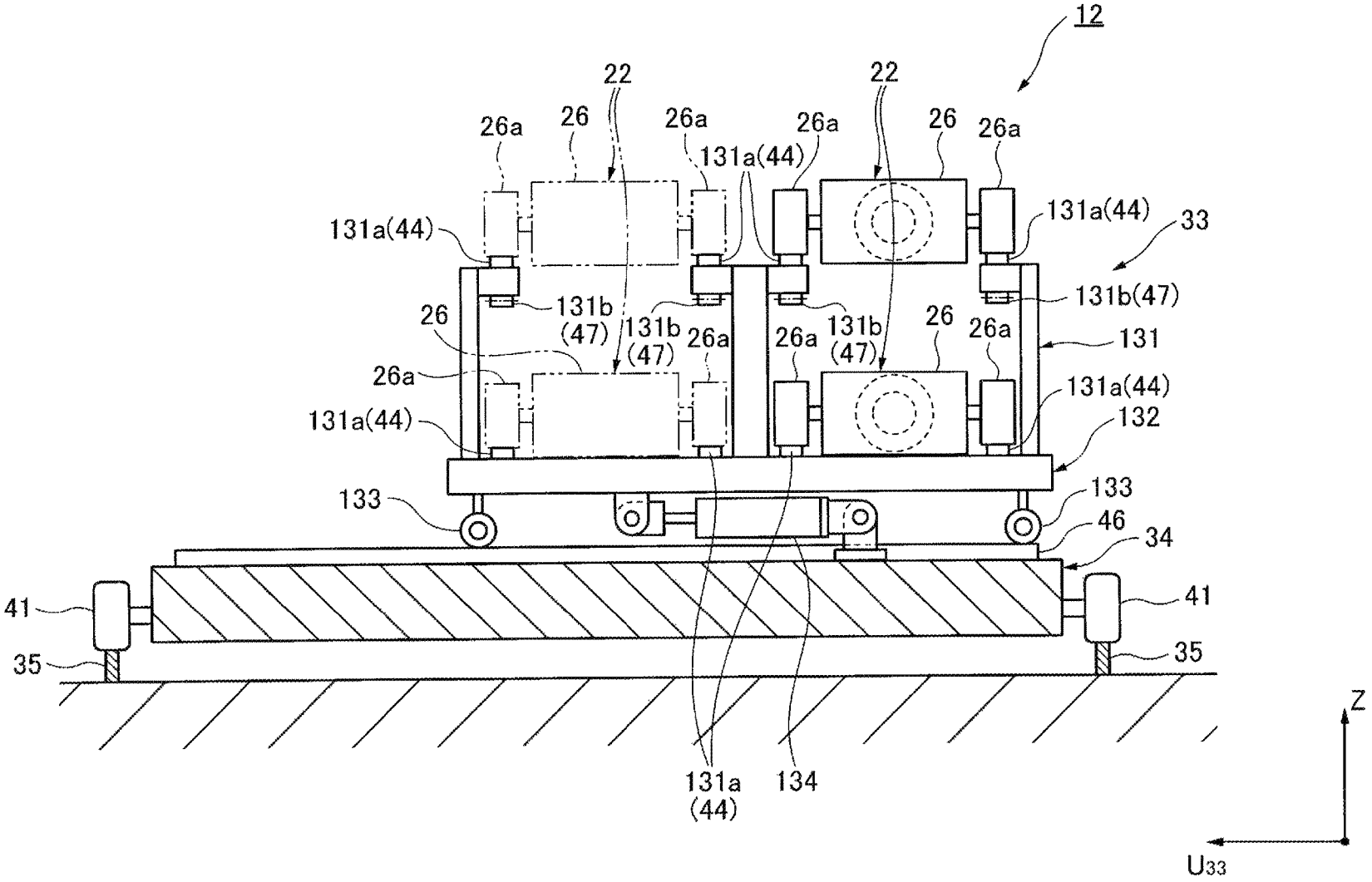
FIG. 10 is a fragmentary sectional view (a sectional view taken along arrows X-X in FIG. 1) illustrating the roll changing device according to Embodiment 1.

Referring to FIG. 1A and FIG. 10, the third rails 46 for causing the back up roll transfer device 33 to travel extend in a direction intersecting with the first rails 44 (a direction intersecting at 90° and parallel to the second rails 75 in this embodiment, that is, a $U_{33}$-axis direction intersecting with the $V_{31}$-axis and parallel to the $U_{32}$-axis). Accordingly, the back up roll transfer device 33 is caused to travel on the device moving carriage 34 in the $U_{33}$-axis direction along the third rails 46.

<Push Puller Device (Roll Holding Device)>

Figure 4:
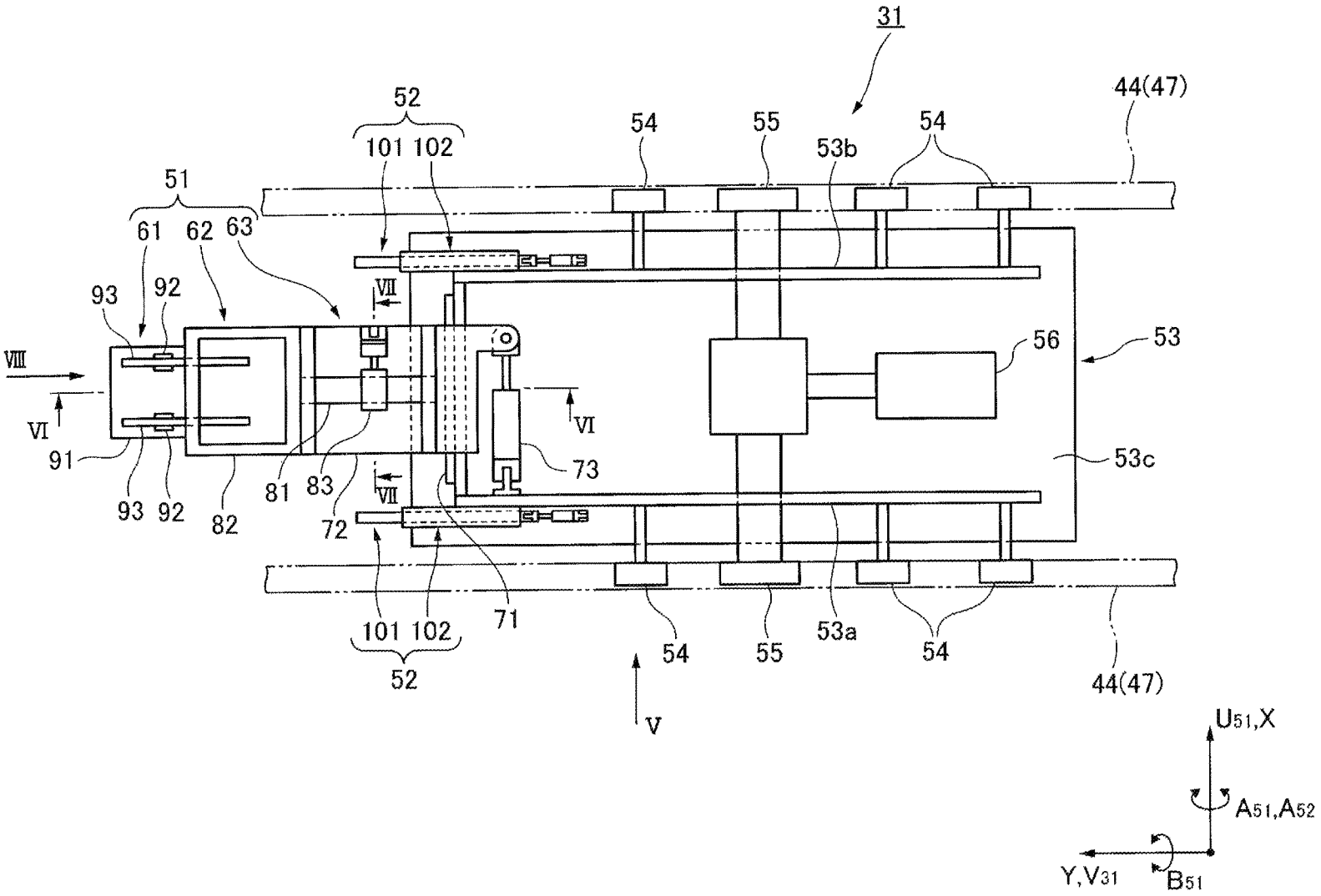
FIG. 4 is an explanatory drawing (plan view) illustrating a push puller device in the roll changing device according to Embodiment 1.

Referring to FIG. 4, the push puller device 31 is provided with: a work roll holding unit 51 which holds the one pair of top and bottom work rolls 21 in an attachable/detachable manner; a back up roll holding unit 52 which holds the one pair of top and bottom back up rolls 22 in an attachable/detachable manner; and a device body 53 including (or is equipped with), and capable of moving, the work roll holding unit 51 and the back up roll holding unit 52.

The device body 53 is provided with: traveling wheels 54 supported on the first rails 44 located at the top side in the vertical direction; drive wheels (pinion gears) 55 which engage with the first rack gears 47; and a drive unit (drive motor) 56 for driving the rotation of the drive wheels 55.

Accordingly, as the drive unit 56 is driven, the device body 53 (the push puller device 31) is caused to travel on the device moving carriage 34 by using the first rails 44 and the back up roll transfer device 33 located at the top side in the vertical direction and is moved closer to or away from the rolling mill 11 (or moved in the roll axis direction).

Incidentally, as the push puller device 31 travels in the state of causing the work roll holding unit 51 or the back up roll holding unit 52 to hold the work rolls 21 or the back up rolls 22 (moving in the roll axis direction relative to the rolling mill 11), it can carry the work rolls 21 or the back up rolls 22 into or out of the rolling mill 11.

<Work Roll Holding Unit>

Figure 6:
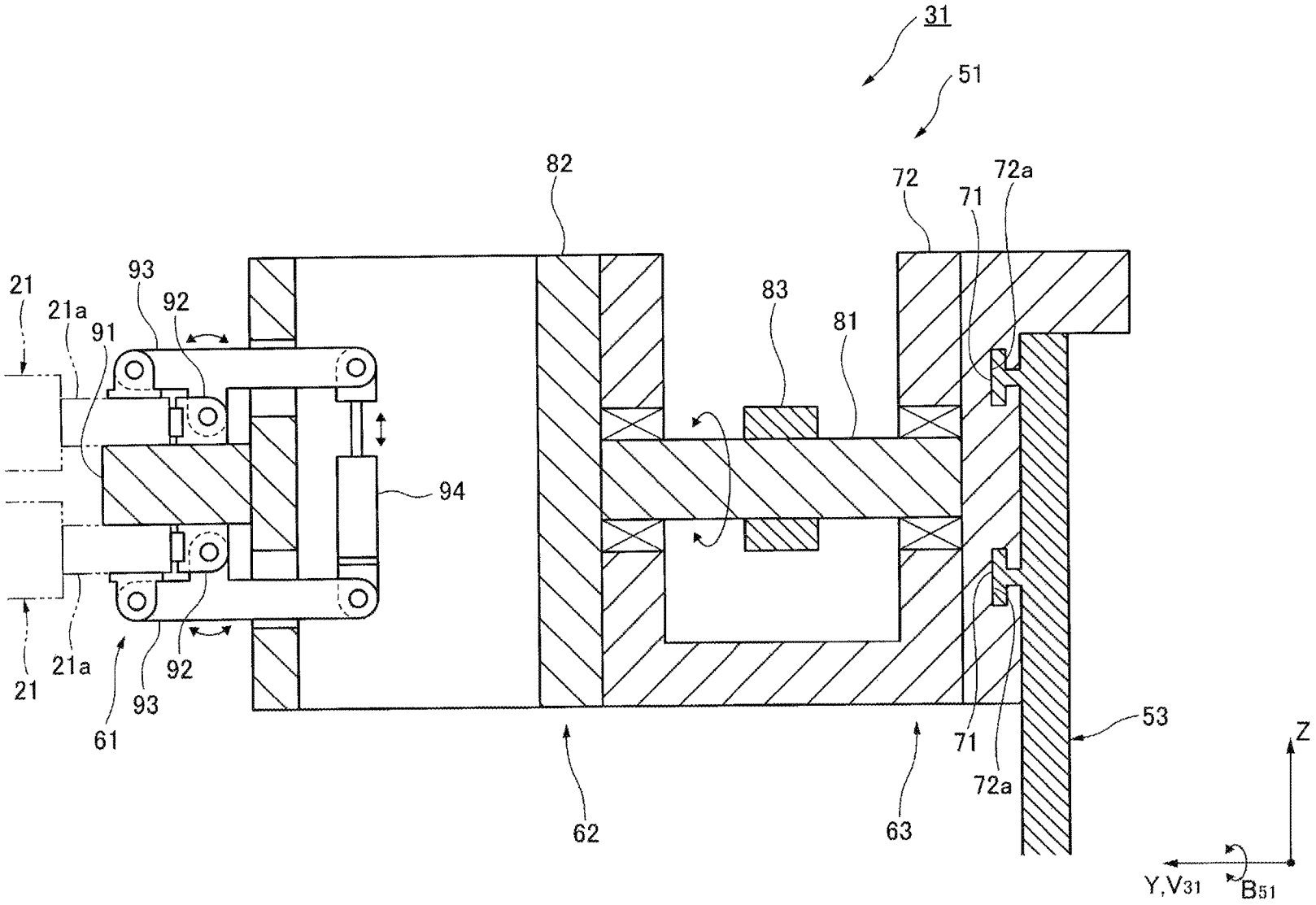
FIG. 6 is a fragmentary sectional view (a sectional view taken along arrows VI-VI in FIG. 4) illustrating the push puller device in the roll changing device according to Embodiment 1.

Referring to FIG. 4 and FIG. 6, the work roll holding unit 51 is provided with: a holding mechanism 61 which holds the work rolls 21 when changing the rolls; a rotating mechanism 62 capable of rotating this holding mechanism 61 (the held work rolls 21) around a rotation axis parallel to the roll axis direction (a $B_{51}$-axis parallel to the Y-axis); and a moving mechanism 63 capable of moving the holding mechanism 61 and the rotating mechanism 62 in a direction parallel to the threading direction (a $U_{51}$-axis direction parallel to the X-axis). Under this circumstance, the work roll holding unit 51 can hold two pairs of work rolls 21, which are located at positions separate from each other in the threading direction, each independently in an attachable/detachable manner and can move the held work rolls 21 in the threading direction.

<Moving Mechanism>

The moving mechanism 63 includes: guiding parts 71 formed to protrude towards a front face of the device body 53 (the surface facing the rolling mill 11); a movable body 72 attached so as to be capable of engaging with, and sliding along, the guiding parts 71; and a movable drive unit 73 which is coupled to this movable body 72 and moves the movable body 72 relative to the device body 53.

Under this circumstance, the guiding parts 71 are rail members that extend in the $U_{51}$-axis direction (the vertical direction in FIG. 4). The movable body 72 has a rigid body with a substantially U-shaped section and long grooves 72*a* which engage with the guiding parts 71 are formed on a rear face of the rigid body. The movable drive unit 73 is an expandable/contractable jack with its base end (the bottom-side end in FIG. 4) coupled to one lateral part 53*a* of the device body 53 and its top end (the top-side end in FIG. 4) coupled to the movable body 72, so that the movable drive unit 73 is expanded or contracted to move the movable body 72 in the $U_{51}$-axis direction along the guiding parts 71.

<Rotating Mechanism>

Figure 7:
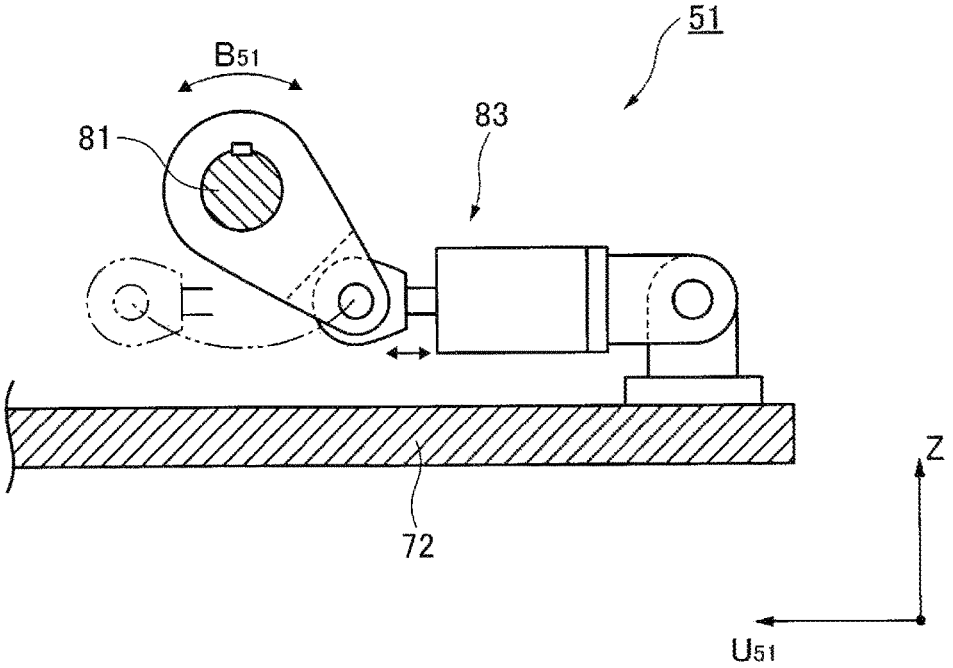
FIG. 7 is a fragmentary sectional view (a sectional view taken along arrows in FIG. 4) illustrating the push puller device in the roll changing device according to Embodiment 1.

Referring to FIG. 4, FIG. 6, and FIG. 7, the rotating mechanism 62 includes: a rotating shaft 81 supported by the movable body 72 in a rotatable manner; a rotating body 82 which is secured to one end of this rotating shaft 81 (the left-side end in FIG. 4 and FIG. 6) and is caused to rotate together with the rotating shaft 81; and a rotary drive unit 83 which is coupled to the rotating shaft 81 and rotates the rotating shaft 81 (and the rotating body 82) around the $B_{51}$-axis.

Under this circumstance, the rotating shaft 81 is capable of rotating around the $B_{51}$-axis relative to the movable body 72. The rotating body 82 is a rigid body formed to be of a cylindrical shape with a rectangular section. The rotary drive unit 83 is an expandable/contractable jack with its base end (the right-side end in FIG. 7) coupled to the movable body 72 and its top end (the left-side end in FIG. 7) coupled to the rotating shaft 81, so that the rotary drive unit 83 is expanded or contracted to move the rotating shaft 81 around the $B_{51}$-axis. Incidentally, in this embodiment, a rotation angle of the rotating shaft 81 and the rotating body 82 which are rotated by the expansion/contraction actions of the rotary drive unit 83 is approximately 90°.

<Holding Mechanism>

Figure 8:
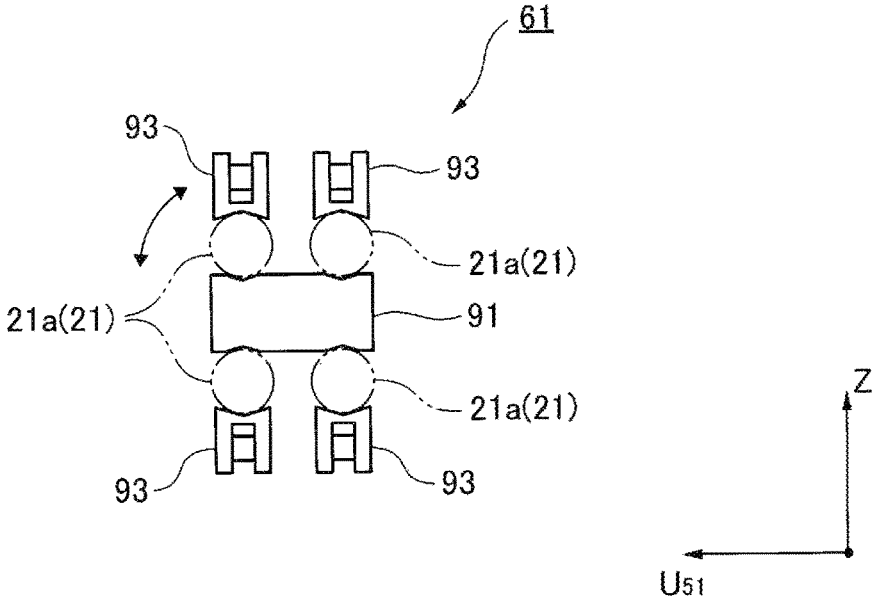
FIG. 8 is a fragmentary sectional view (a view as seen from arrow VIII in FIG. 4) illustrating the push puller device in the roll changing device according to Embodiment 1.

Referring to FIG. 4. FIG. 6, and FIG. 8, the holding mechanism 61 can hold one pair or two pairs of work rolls 21 at the same time and the holding mechanism 61 includes: a flat plate part (support ember) 91 which is placed between the shaft ends 21*a* of the one pair or two pairs of work rolls 21 (or which is inserted in contact with the respective side faces of the shaft ends 21*a*) when holding the one pair or two pairs of work rolls 21; protrusions 92 which are respectively made to enter into contact with the end faces of the shaft ends 21*a* of the one pair or two pairs of work rolls 21; and swinging units (clamp members) 93 which press the shaft ends 21*a* against the flat plate part 91 so as to hold the shaft ends 21*a* of the one pair or two pairs of work rolls 21 between them.

Under this circumstance, the flat plate part 91 is a flat plate member which extends from the front face of the rotating body 82 towards the front side of the apparatus (the rolling mill 11 side, that is, the left side in FIG. 4 and FIG. 6) and which can be inserted between the shaft ends 21*a* of the two pairs of work rolls 21. Then, the flat plate part 91 enters a state of extending in the horizontal direction or the vertical direction in association with the rotation operation (90° rotation operation) by the rotating mechanism 62 and is inserted between the shaft ends 21*a* of the two pairs of work rolls 21 which are separated from each other in the horizontal direction or the vertical direction.

The protrusions 92 are formed to protrude from one side (the top face in FIG. 6) and the other side (the bottom face in FIG. 6) of the flat plate part 91, respectively, and two protrusions 92 are located on each of the one side and the other side so as to correspond to the relevant two pairs of work rolls 21 when holding the two pairs of work rolls 21 (so that the protrusions 92 will enter into contact with the end faces of the shaft ends 21*a* of the respective work rolls 21 [a total of four work rolls], respectively). Specifically speaking, the flat plate part 91 is provided with two sets of one pair of protrusions 92 (that is, two pairs) (see FIG. 6) which protrude from both sides of the flat pate part 91 and are separated from each other in the threading direction (the vertical direction in FIG. 4).

The swinging unit 93 is mounted in such a manner that it can swing around a specified rotation axis ($A_{51}$-axis) relative to the protrusion 92; and two pairs of (that is, a total of four) swinging units 93 are provided and located at positions corresponding to the two pairs of (that is, a total of four) protrusions 92, respectively, that is, the two pairs of (the total of four) swinging units 93 are provided together with the protrusions 92 at positions separated from each other in the threading direction (the vertical direction in FIG. 4).

Furthermore, as illustrated in FIG. 6, the holding mechanism 61 is provided with swinging drive units 94 which swing the swinging units 93 relative to the flat plate part 91 and the protrusions 92. Each swinging drive unit 94 is an expandable/contractable jack (hydraulic cylinder) with its base end (bottom-side end in FIG. 6) and its top end (top-side end in FIG. 6) respectively coupled to one pair of swinging units 93; and two swinging drive units 94 are provided so that it can swing each of the two pairs of swinging units 93 independently.

As the swinging drive unit 94 is expanded or contracted, each of the pair of swinging units 93 coupled to the relevant swinging drive unit 94 is swung relative to the flat plate part 91 and the protrusions 92. Specifically speaking, as the swinging drive unit 94 is expanded, the shaft ends 21*a* of one pair (or two pairs) of work rolls 21 are held between the swinging units 93 and the flat plate part 91 which are coupled to the relevant swinging drive unit 94; and as the swinging drive unit 94 is contracted, the shaft ends 21*a* of the one pair (or two pairs) of work rolls 21 which are held between the swinging units 93 and the flat plate part 91 that are coupled to the relevant swinging drive unit 94 are released. Under this circumstance, each of the two swinging drive units 94 can be driven (expanded or contracted) independently; and as the swinging units 93 includes these two swinging drive units 94, they can press each of the shaft ends 21*a* of the two pairs of work rolls 21 independently against the flat plate part 91.

Incidentally, as the work roll holding unit 51 operates the rotating mechanism 62 (expands or contracts the rotary drive unit 83) in the state of holding the work rolls 21, it can change an arrangement direction of the work rolls 21. Specifically speaking, as the holding mechanism 61 is rotated around the $B_{51}$-axis towards one side by the operation of the rotating mechanism 62, the pair of work rolls 21 enters into a state of being arranged in the vertical direction; and on the other hand, as the holding mechanism 61 is rotated around the $B_{51}$-axis towards the other side, the one pair of top and bottom work rolls 21 enters into a state of being arranged in the horizontal direction.

Under this circumstance, the state where the work rolls 21 constituting one pair are arranged in the vertical direction is a state where the flat plate part 91 extends in the horizontal direction, that is, a state where the pair of work rolls 21 is held between the swinging units 93 in the vertical direction. On the other hand, the state where the top and bottom work rolls 21 constituting one pair are arranged in the horizontal direction is a state where the flat plate part 91 extends in the vertical direction, that is, a state where the pair of work rolls 21 is held between the swinging units 93 in the horizontal direction. Specifically speaking, the $A_{51}$-axis which is the rotation axis of the swinging units 93 is turned to the horizontal direction (a direction parallel to the X-axis) or the vertical direction (a direction parallel to the Z-axis) by the operation of the holding mechanism 61.

<Back Up Roll Holding Unit (Second Roll Holding Unit)>

Referring to FIG. 4 and FIG. 5A, the back up roll holding unit 52 is provided with: latching mechanisms 101 which hold (or hook) the back up rolls 22 when carrying the back up rolls 22 out of the rolling mill 11; and pressing mechanisms 102 which hold (or press) the back up rolls 22 when carrying the back up rolls 22 into the rolling mill 11. Specifically speaking, the back up roll holding unit 52 includes: the latching mechanisms 101 which engage with the one pair of top and bottom back up rolls 22 and is caused by the movement of the push puller device 31 to carry the back up rolls 22 out of the rolling mill 11; and the pressing mechanisms 102 which enter into contact with the one pair of top and bottom back up rolls 22 and is caused by the movement of the push puller device 31 to carry the back up rolls 22 into the rolling mill 11.

<Latching Mechanism>

The latching mechanism 101 is provided with a latch swinging unit 111 which has a hook part 111*a* capable of engaging with the hook part 29*a* of the latch member 29 for the back up rolls 22 and is supported so as to be capable of rotating round the rotation axis parallel to the threading direction an $A_{52}$-axis parallel to the X-axis relative to the device body 53.

Two latch swinging units 111 (a total of four) are located on each of both lateral parts 53*a*, 53*b* of the device body 53 at positions separated from each other in the vertical direction so that they correspond to the two pairs of top and bottom latch members 29 (the latch members 29 for one pair of top and bottom back up rolls 22), respectively; and the hook part 111*a* provided at each latch swinging unit 111 is formed so that it corresponds to (or can engage with) the hook part 29*a* of each of the two pairs of top and bottom latch members 29.

Specifically speaking, the hook parts 111*a* of the one pair of top and bottom latch swinging units 111 provided at one lateral part 53*a* of the device body 53 and the hook parts 111*a* of the one pair of top and bottom latch swinging units 111 provided at the other lateral part 53*b* of the device body 53 are placed so that they protrude to face opposite directions. Specifically speaking, the hook parts 111*a* of the two latch swinging units 111 provided at the bottom side in the vertical direction are respectively formed to protrude towards the bottom side in the vertical direction and the hook parts 111*a* of the two latch swinging units 111 provided at the top side in the vertical direction are respectively formed to protrude towards the top side in the vertical direction.

Furthermore, the latching mechanism 101 is provided with: a latch drive unit 112 which is coupled to the latch swinging unit 111 at the top side in the vertical direction and swings that latch swinging unit 111; and a latch interlocking unit 113 coupled to the latch swinging units 111 located to constitute a pair in the vertical direction. Under this circumstance, the latch interlocking unit 113 causes the swinging action of the latch swinging unit 111 at the top side in the vertical direction to be transmitted to the latch swinging unit 111 at the bottom side in the vertical direction. Therefore, the latch drive unit 112 is driven to cause the latch swinging unit 111 located at the top side in the vertical direction to swing and also causes, via the latch interlocking unit 113, the latch swinging unit 111 located at the bottom side in the vertical direction to swing relative to the device body 53.

The latch drive unit 112 is an expandable/contractable jack with its base end (the bottom-side end in FIG. 5A) coupled to a bottom 53*c* of the device body 53 and its top end (the top-side end in FIG. 5A) coupled to the latch swinging unit 111, so that the latch drive unit 112 is expanded or contracted to cause the latch swinging unit 111 to swing around the $A_{52}$-axis with the rotation center shaft 111*b* as the rotation center.

Figure 5B:
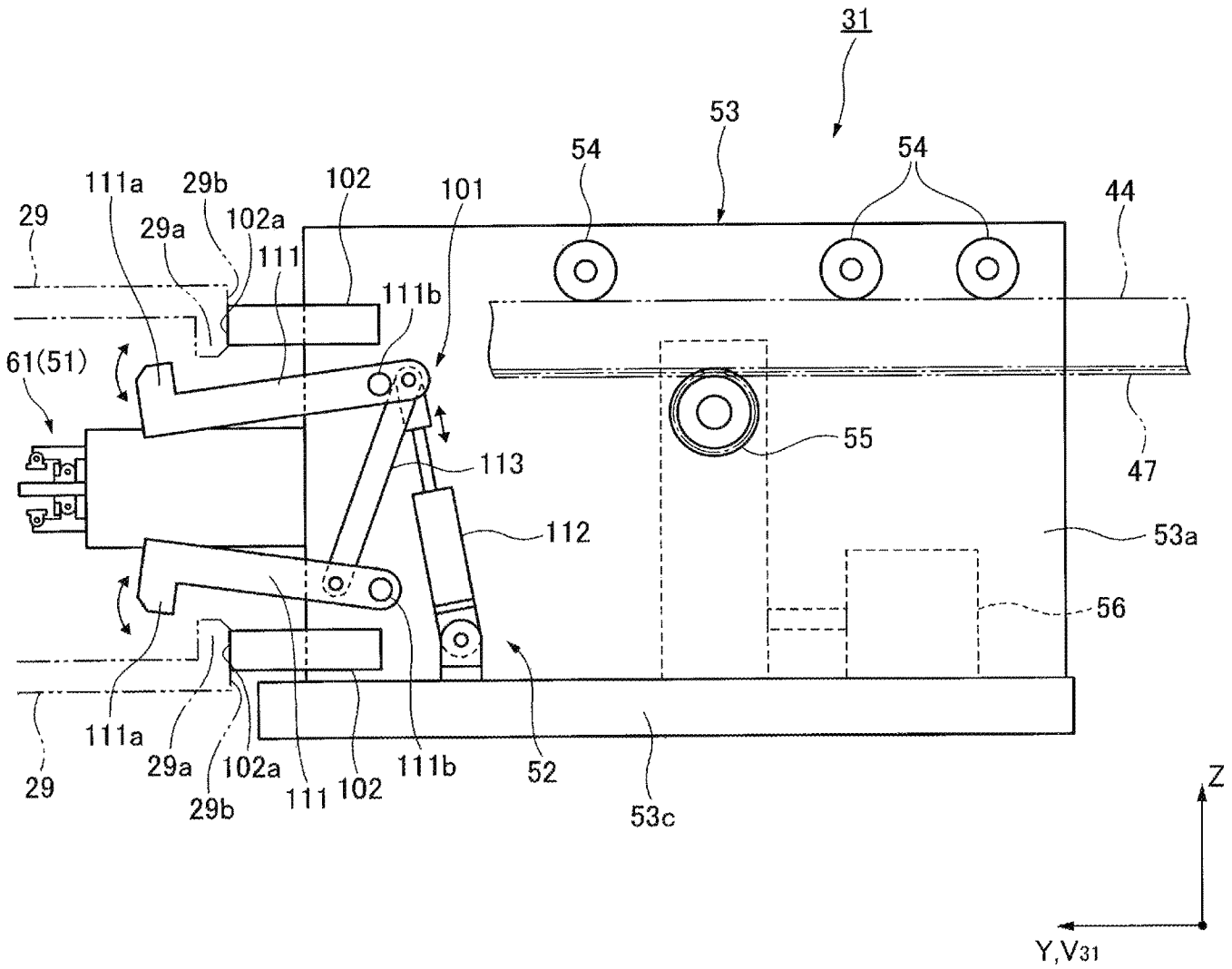
FIG. 5B is a side view (a view as seen from arrow V in FIG. 4) illustrating the push puller device in the roll changing device according to Embodiment 1.

Incidentally, the top end of the latch drive unit 112 is coupled at a position closer to the rear end side than the rotation center shaft 111*b* of the latch swinging unit 111 (the right side in FIG. 5A). Accordingly, when the length of the latch drive unit 112 is contracted, the latch swinging unit 111 is swung so as to rotate towards one side (clockwise in FIG. 5A) and the hook part 111*a* of that latch swinging unit 111 is moved towards the top side in the vertical direction and engages with the hook part 29*a* of the latch member 29. On the other hand, when the length of the latch drive unit 112 is expanded as illustrated in FIG. 5B, the latch swinging unit 111 is swung to rotate towards the other side (counterclockwise in FIG. 5B) and the hook part 111*a* of that latch swinging unit 111 is moved towards the bottom side in the vertical direction and its engagement with the hook part 29*a* of the latch member 29 is released.

One end (the top-side end in FIG. 5A) of the latch interlocking unit 113 is coupled at a position closer to the rear end side than the rotation center shaft 111*b* of the latch swinging unit 111 at the top side in the vertical direction; and the other end (the bottom-side end in FIG. 5A) is coupled at a position closer to the top end side (the left side in FIG. 5A) than the rotation center shaft 111*b* of the latch swinging unit 111 at the bottom side in the vertical direction. Accordingly, the latch swinging unit 111 located at the top side in the vertical direction and the latch swinging unit 111 located at the bottom side in the vertical direction swing to rotate in directions opposite to each other.

Therefore, regarding the roll changing device 12, the back up rolls 22 can be carried out of the rolling mill 11 by causing the push puller device 31 to travel in the state of causing the latching mechanism 101 of the back up roll holding unit 52 to hold (or hook) the back up rolls 22, that is, in the state where the hook parts 29*a* of the latch members 29 engages with the hook parts 111*a* of the latch swinging units 111. Incidentally, the latch members 29 (the hook parts 29*a*) and the latch swinging units 111 (the hook parts 111*a*) are provided at the upstream side in the threading direction and the downstream side in the threading direction, respectively, relative to the one pair of top and bottom back up rolls 22, so that the push puller device 31 can carry out the one pair of top and bottom back up rolls 22 in a straight manner (well-balanced manner).

<Pressing Mechanism>

The pressing mechanism 102 is a pressing member secured to the device body 53 and has a contact face 102*a* which can come into contact with the top end face 29*b* of the latch member 29. Furthermore, two pressing mechanisms 102 (a total of four) are located on each of both lateral parts 53*a*, 53*b* of the device body 53 at positions separated from each other in the vertical direction so that they correspond to the two pairs of top and bottom latch members 29 (the latch members 29 for one pair of top and bottom back up rolls 22), respectively.

Therefore, regarding the roll changing device 12, the back up rolls 22 can be carried into the rolling mill 11 by causing the push puller device 31 to travel in the state of causing the pressing mechanism 102 of the back up roll holding unit 52 to hold (or press) the back up rolls 22, that is, in the state where the top end faces 29*b* of the latch members 29 at the roll chocks 26 are in contact with the contact faces 102*a* of the pressing mechanisms 102. Incidentally, the latch members 29 (the top end faces 29*b*) and the pressing mechanisms 102 (the contact faces 102*a*) are provided at the upstream side in the threading direction and the downstream side in the threading direction, respectively, relative to the one pair of top and bottom back up rolls 22, so that the push puller device 31 can carry the one pair of top and bottom back up rolls 22 inside in a straight manner (well-balanced manner).

<Work Roll Transfer Device>

Referring to FIG. 1A and FIG. 9, the work roll transfer device 32 is provided with: a rack member 121 on which the work rolls 21 can be mounted; and a carrier 122 including (or being equipped with), and capable of moving, this rack member 121. Incidentally, the roll changing device 12 includes a plurality of (two) work roll transfer devices 32; and these two work roll transfer devices 32 have the same configuration, except that they are placed opposite to each other with a traveling path (the first rails 44) of the push puller device 31 between them on the device moving carriage 34 and their structures are symmetric.

The rack member 121 has notched grooves 121*a* formed therein to receive the both shaft ends 21 of the work rolls 21 and three work rolls 21 (a total of six rolls) can be placed in each of the top and bottom racks.

Furthermore, the carrier 122 is provided with: traveling wheels 123 supported on the second rails 45; drive gears (pinion gears) 124 which engage with the second rack gears 48; and a drive motor 125 for driving the rotation of the drive gears 123 via a gear mechanism. Under this circumstance, the second rails 45 and the second rack gears 48 of the device moving carriage 34 extend in a direction (the $U_{32}$-axis direction) intersecting with the first rails 44 and the first rack gears 47. Accordingly, as the drive motor 125 is driven, the carrier 122 (the work roll transfer device 32) in the state equipped with the rack members 121 can be moved in the $U_{32}$-axis direction (the direction intersecting with the moving path of the push puller device 31) along the second rails 45 and be positioned on the traveling path of the push puller device 31.

When the work roll transfer device 32 is positioned on the traveling path of the push puller device 31, the work rolls 21 which have been held by the push puller device 31 can be delivered to and mounted on the work roll transfer device 32 or the push puller device 31 can receive and hold the work rolls 21 mounted on the work roll transfer device 32. Specifically speaking, the push puller device 31 gives/receives the work rolls 21 to/from the work roll transfer device 32 which has been moved to the moving path of that push puller device 31. Incidentally, when the work roll transfer device 32 is located at a position separated from the traveling path of the push puller device 31, the work rolls 21 will not be given to, or received from, the push puller device 31 and the work roll transfer device 32 is in a standby state.

It is a matter of course that the present invention is not limited to this embodiment and, for example, the work roll transfer device 32 may be moved in the $U_{32}$-axis direction along the second rails 45 by directly driving the rotation of the traveling wheels by using the drive motor or by pushing or pulling the work roll transfer device 32 by using a hydraulic jack or the like.

<Back Up Roll Transfer Device (Second. Roll Transfer Device)>

Referring to FIG. 1A and FIG. 10, the back up roll transfer device 33 is provided with: a rack member 131 on which the back up rolls 22 can be mounted; and a carrier 132 including (or being equipped with), and capable of moving, this rack member 131.

The rack member 131 is provided with: a rail part 131*a* which is connected consecutively to the first rails 44 and extends in the roll axis direction; and rack gears 131*b* which are connected consecutively to the first rack gears 47. The pair of top and bottom back up rolls 22 are mounted in a manner such that they can be moved on the rail part 131*a* in the roll axis direction. Furthermore, two pairs of back up rolls 22 (a total of four rolls) can be mounted on the rack member 131 at positions separated from each other in the $U_{33}$-axis direction.

The carrier 132 is provided with traveling wheels 133 supported on the third rails 46 and a drive unit 134 coupled to the device moving carriage 34. The drive unit 134 is an expandable/contractable jack with its base end (the right-side end in FIG. 10) coupled to the device moving carriage 34 and its top end (the left-side end in FIG. 10) coupled to the carrier 132, so that the drive unit 134 can be expanded or contracted to move the carrier 123 in the $U_{33}$-axis direction along the third rails 46. Then, as the drive unit 134 is expanded or contracted, the carrier 132 (the back up roll transfer device 33) can be moved, in the state equipped with the rack members 131, in the $U_{33}$-axis direction (the direction intersecting with the moving path of the push puller device 31) along the third rails 46 and be positioned on the traveling path of the push puller device 31.

When the back up roll transfer device 33 is positioned on the traveling path of the push puller device 31, the back up rolls 22 which have been held by the push puller device 31 can be delivered to and mounted on the back up roll transfer device 33 or the push puller device 31 can receive and hold the back up rolls 22 mounted on the back up roll transfer device 33. Specifically speaking, the push puller device 31 gives/receives the back up rolls 22 to/from the back up roll transfer device 33 which has been moved to the moving path of that push puller device 31. Incidentally, when the back up roll transfer device 33 is located at a position separated from the traveling path of the push puller device 31, the back up rolls 22 will not be given to, or received from, the push puller device 31 and the back up roll transfer device 33 is in a standby state.

Furthermore, when the back up roll transfer device 33 (the rack member 131) is positioned between the split first rails 44 as described earlier, the rail part 131*a* of the rack member 131 in that back up roll transfer device 33 is coupled to the first rails 44 and serves as part of the rails where the push puller device 31 travels. Specifically speaking, the rail part 131*a* in the back up roll transfer device 33 constitutes part of the rails where the push puller device 31 travels from its retracted position to its roll change position adjacent to the rolling mill 11; and the push puller device 31 can be moved closer to, or away from, the rolling mill 11 via the rail part 131*a* of the back up roll transfer device 33.

It is a matter of course that the present invention is not limited to this embodiment and, for example, the work roll transfer device 32 may be moved in the $U_{33}$-axis direction along the third rails 46 by directly driving the rotation of the traveling wheels by using the drive motor or by pushing or pulling the back up roll transfer device 33 by using a drive motor gear mechanism (pinions and racks) or the like. Furthermore, the above explanation has been given by taking the back up rolls as an example; however, in a case of a six-high rolling mill, the present invention can be also applied to intermediate rolls.

The device moving carriage 34 functions as a mount which is a base for equipment such as the push puller device 31, the work roll transfer device 32, and the back up roll transfer device 33 as described above and is properly equipped with traveling devices for the equipment such as the first rails 44, the second rails 45, and the third rails 46. For example, the device moving carriage 34 is formed by properly changing its top face height (thickness) so that the height of the first rails 44 located at the bottom side in the vertical direction becomes uniform in an area where the work roll transfer device 32 moves (a front-side area of the device moving carriage 34), an area where the back up roll transfer device 33 moves (a center area of the device moving carriage 34), and an area where the push puller device 31 stands by (a rear-side area of the device moving carriage 34).

Since the roll changing device 12 includes the device moving carriage 34 which is configured as described above, the roll changing device 12 can move the equipment such as the push puller device 31, that is, the group of devices which contribute to the change of the rolls, closer to or away from the rolling mill 11 at once.

<Work Roll Changing Procedure>

The procedure for changing the work rolls in the rolling equipment equipped with the roll changing device according to Embodiment 1 of the present invention will be explained below with reference to FIG. 1A to FIG. 2E.

Firstly, a crane or the like which is not illustrated in the drawings is used to mount one pair of new work rolls 21 (two rolls), which are to be incorporated into the rolling mill 11, on the rack member 121 of the work roll transfer device 32 (see FIG. 1A). Under this circumstance, the pair of work rolls 21 is mounted by placing one of the work rolls on an top rack of the rack member 121 and the other work roll 21 on a bottom rack of the rack member 121 to arrange them in the vertical direction or by placing the pair of work rolls 21 in adjacent notched grooves 121*a* of the rack member 121 to arrange them in the horizontal direction (see FIG. 9).

Figure 1B:
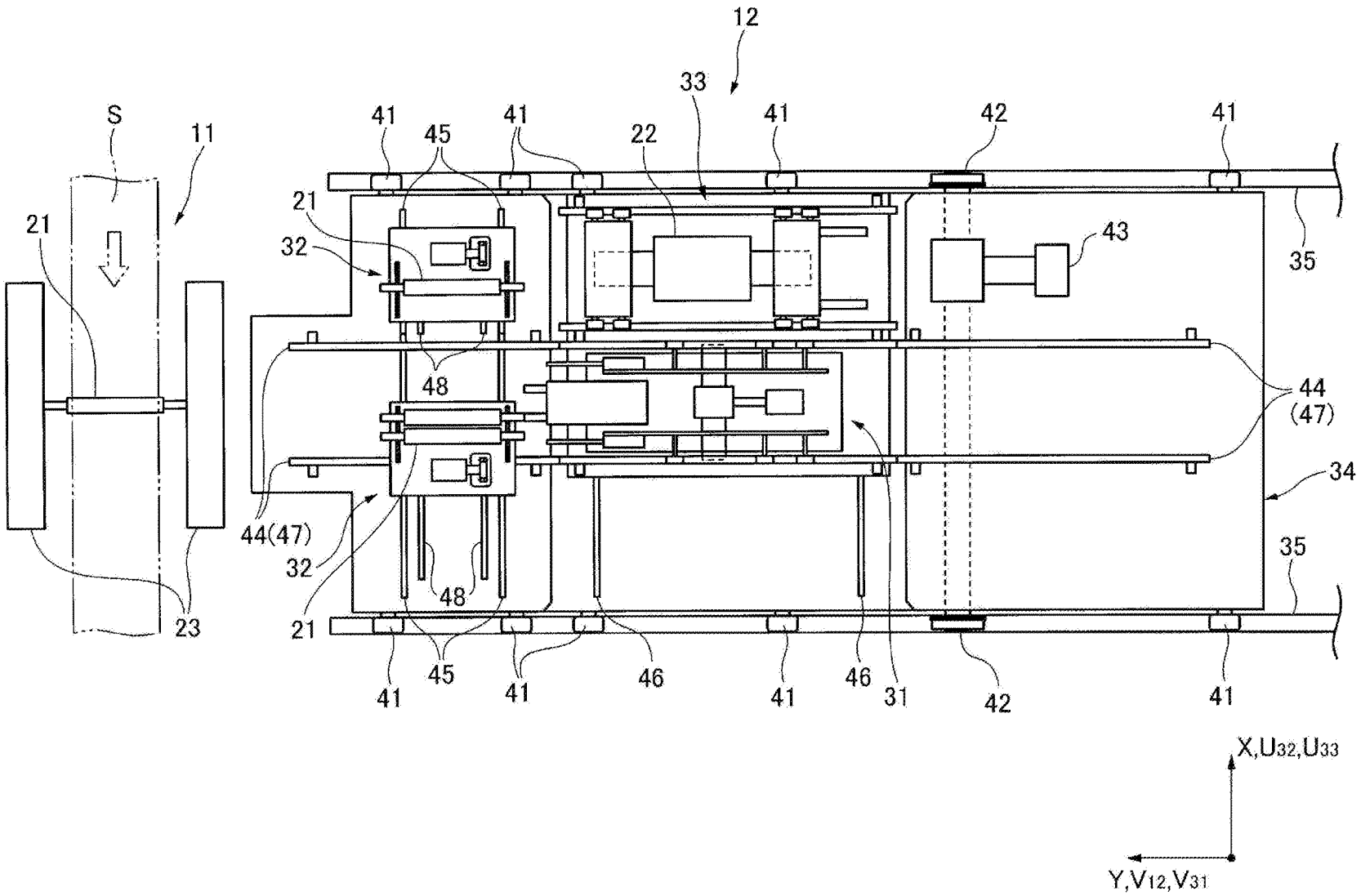
FIG. 1B is an explanatory drawing (corresponding to FIG. 1A) illustrating a work roll change operation by the roll changing device according to Embodiment 1.

Next, the work roll transfer device 32 is positioned on the traveling path of the push puller device 31 and the push puller device 31 is also moved close to the work roll transfer device 32, thereby causing the work roll holding unit 51 to hold the pair of work rolls 21 mounted on the rack member 121 (see FIG. 1B).

Under this circumstance, the flat plate part 91 is placed between the shaft ends 21*a* of the pair of work rolls 21 mounted on the rack member 121 by operating the swinging drive unit 94 to move the push puller device 31 (closer to the work roll transfer device 32) in the state where the top ends of the swinging units 93 are opened; and subsequently, by operating the swinging drive unit 94 to close the top ends of the swinging units 93, the pair of work rolls 21 can be held by the work roll holding unit 51 (see FIG. 6).

Furthermore, when the work rolls 21 constituting one pair are mounted and arranged in the vertical direction (in the top rack and the bottom rack of the rack member 121) in the work roll transfer device 32, the pair of work rolls 21 can be held by the work roll holding unit 51 by operating the rotary drive unit 83 to cause one pair of swinging units 93 to enter the state of being opened or closed (see FIG. 7 and FIG. 8).

On the other hand, when the work rolls 21 constituting one pair are mounted and arranged in the horizontal direction (in the adjacent notched grooves 121*a*) in the work roll transfer device 32, the pair of work rolls 21 can be held by the work roll holding unit 51 by operating the rotary drive unit 83 to cause one pair of swinging units 93 to enter the state of being opened or closed.

Figure 1C:
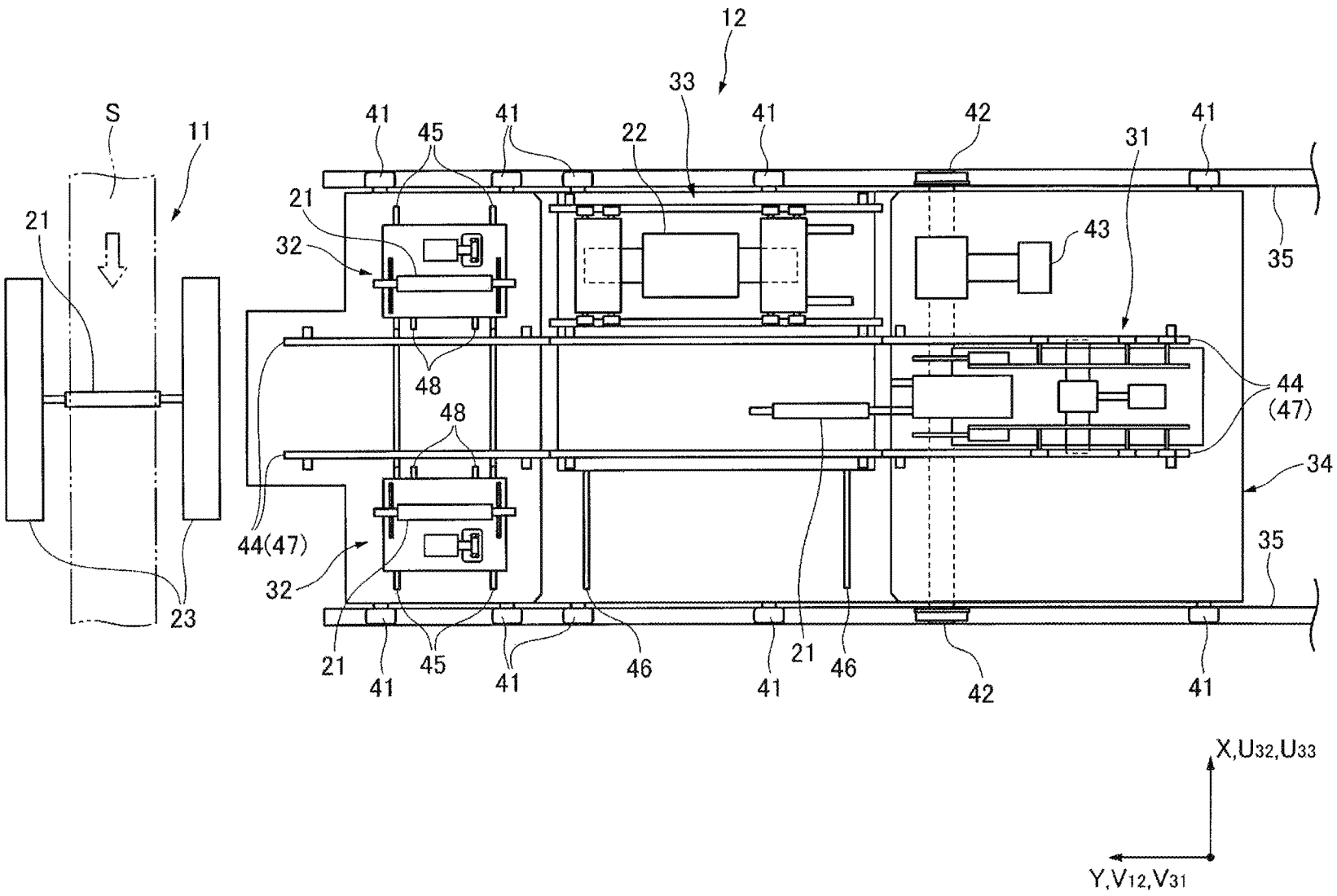
FIG. 1C is an explanatory drawing (corresponding to FIG. 1A) illustrating the work roll change operation by the roll changing device according to Embodiment 1.

Next, the push puller device 31 is moved and retracted to the rear side of the apparatus (the side away from the rolling mill 11, that is, the right side in FIG. 1C) and the work roll transfer device 32 is moved away from the traveling path of the push puller device 31, and then the push puller device 31 is moved to the front side of the apparatus (the left side in FIG. 1C), thereby carrying the work rolls 21 into the rolling mill 11 (see FIG. 1C).

The work rolls 21 are carried into the rolling mill 11 by stopping the rolling operation of the rolling mill 11 (see FIG. 2A). Incidentally, the work rolls 21 can be carried into the rolling mill 11 in the state where the strip S which has already passed through the rolling mill 11 is left inside the rolling mill 11 as it is.

Firstly, one side of the support jacks 25 (the top side in FIG. 2B) is expanded to support the one pair of top and bottom work rolls 21 in the rolling position and then the opening/closing door 23*b* of the rolling mill 11 is opened (see FIG. 2B).

Next, the push puller device 31 is caused to travel and the one pair of work rolls 21 held by the work roll holding unit 51 is carried into the rolling mill 11 and the one pair of top and bottom work rolls 21 which is supported at the rolling position is held by the work roll holding unit 51, and then the one side of the support jacks 25 (the top side in FIG. 2C) is contracted and thereby retracted (see FIG. 2C).

Under this circumstance, the work roll holding unit 51 results in holding the two pairs of work rolls 21 (four rolls). Incidentally, when carrying a new one pair of work rolls 21 into the rolling mill 11, the one pair of work rolls 21 in the state of being arranged in the vertical direction is carried into the rolling mill 11 and the swinging units 93 on the side where that pair of work rolls 21 is not being held are operated by the swinging drive unit 94, so that the one pair of top and bottom work rolls 21 supported at the rolling position is held.

Subsequently, the movable drive unit 73 is operated to move the holding mechanism 61 in the $U_{51}$-axis direction, the new one pair of work rolls 21 is positioned at the rolling position, and the other side of the support jacks 25 are expanded to support that one pair of work rolls 21 (see FIG. 2D and FIG. 4).

Next, the push puller device 31 is moved and retracted to the rear side (see FIG. 2E), then the opening/closing door 23*b* is closed to cause the support roller 24 to support the one pair of top and bottom work rolls 21 and the support jacks 25 are contracted and retracted (see FIG. 2A).

As a result, the new one pair of work rolls 21 is carried into the rolling mill 11 and held at the rolling position and the used one pair of work rolls 21 is carried out of the rolling mill 11.

Figure 1D:
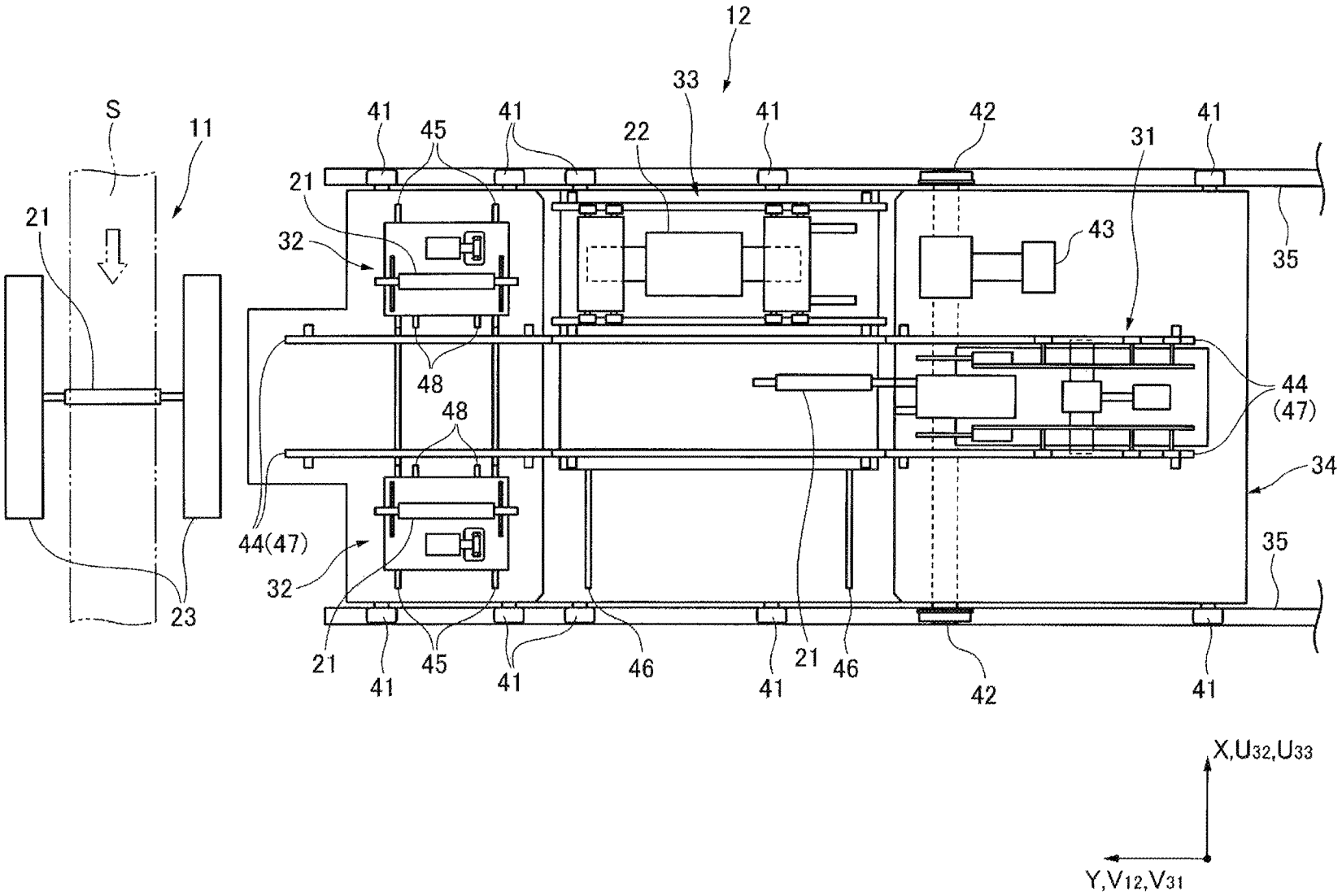
FIG. 1D is an explanatory drawing (corresponding to FIG. 1A) illustrating the work roll change operation by the roll changing device according to Embodiment 1.

Under this circumstance, the push puller device 31 which holds the used work rolls 21 is moved behind the work roll transfer device 32 (see FIG. 1D).

Figure 1E:
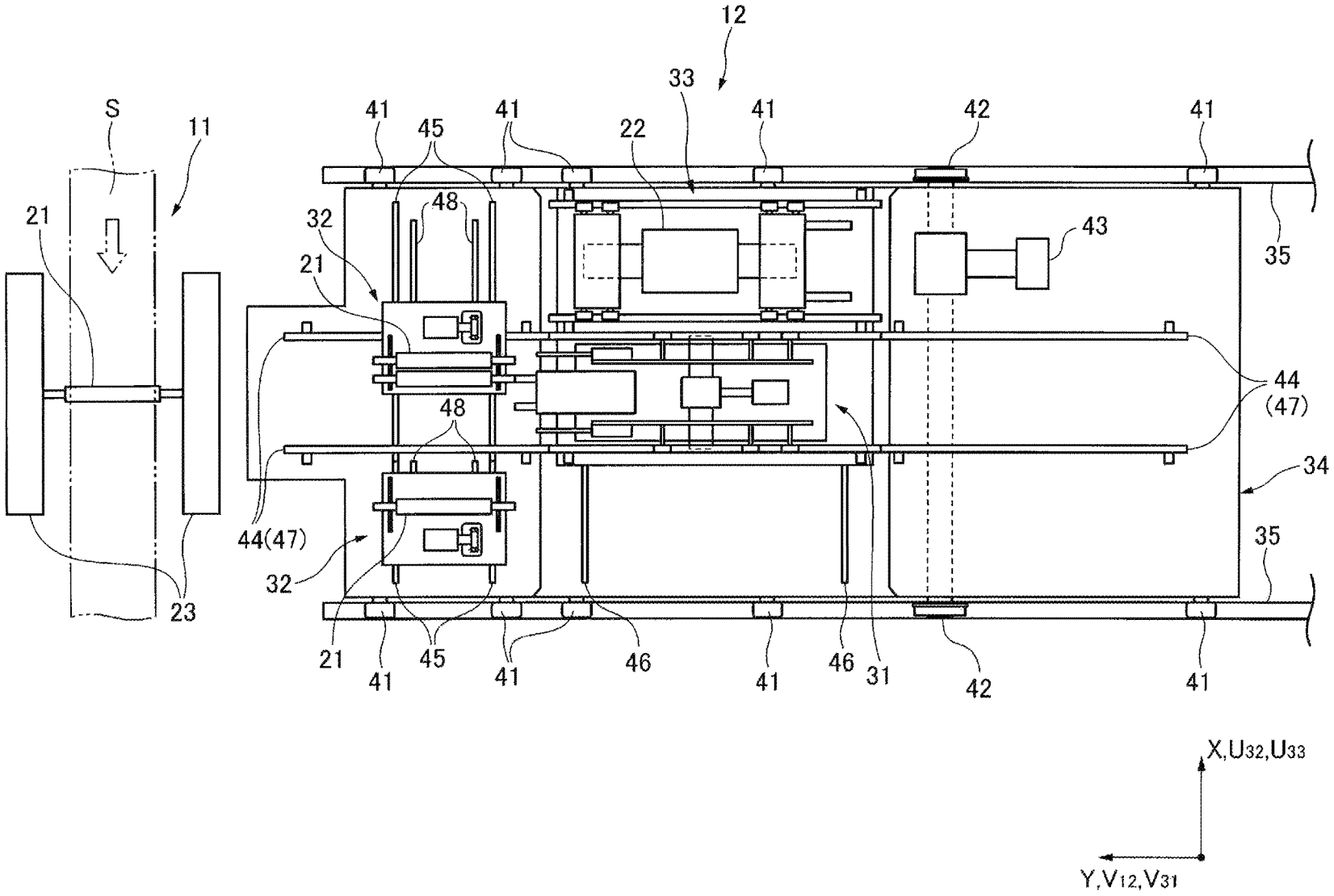
FIG. 1E is an explanatory drawing (corresponding to FIG. 1A) illustrating the work roll change operation by the roll changing device according to Embodiment 1.

Next, the work roll transfer device 32 is positioned on the traveling path of the push puller device 31 and the push puller device 31 is moved close to the work roll transfer device 32, thereby mounting the one pair of work rolls 21, which is held by the work roll holding unit 51, on the rack member 121 (see FIG. 1E).

Under this circumstance, the one pair of work rolls 21 can be mounted on the work roll transfer device 32 so that the work rolls 21 are arranged in the horizontal direction (in the adjacent notched grooves 121*a*) or the one pair of work rolls 21 can be mounted on the work roll transfer device 32 so that the work rolls 21 are arranged in the vertical direction (on the top rack and the bottom rack of the rack member 121) by operating the rotary drive unit 83 to cause the holding mechanism 61 and the one pair of work rolls 21 held by that holding mechanism 61 to rotate around the $B_{51}$-axis (see FIG. 4 and FIG. 7 to FIG. 9).

The roll changing device 12 according to this embodiment can carry the used work rolls 21 outside and carry the pre-used work rolls 21 inside at the same time by the sequence of operations of the push puller device 31 as explained above, so that the time required for the (roll change) work to change the one pair of top and bottom work rolls 21 in the rolling mill 11 can be shortened.

<Back Up Roll Changing Procedure>

The procedure for changing the back up rolls in the rolling equipment equipped with the roll changing device according to Embodiment 1 of the present invention will be explained below with reference to FIG. 3A to FIG. 3D.

Firstly, the push puller device 31 is moved to the front side of the apparatus to carry one pair of top and bottom back up rolls 22 out of the rolling mill 11 (see FIG. 3A).

Under this circumstance, the hook parts 111*a* of the latch swinging units 11 are positioned to be capable of engaging with the hook parts 29*a* of the latch members 29 by operating the latch drive unit 112 to move the push puller device 31 in the state where the top ends of the latch swinging units 111 are closed (see FIG. 5B); and subsequently, by operating the latch drive unit 112 to open the latch swinging units 111, the one pair of top and bottom back up rolls 22 can be held (or hooked) by the back up roll holding unit 52 (see FIG. 5A).

Figure 3B:
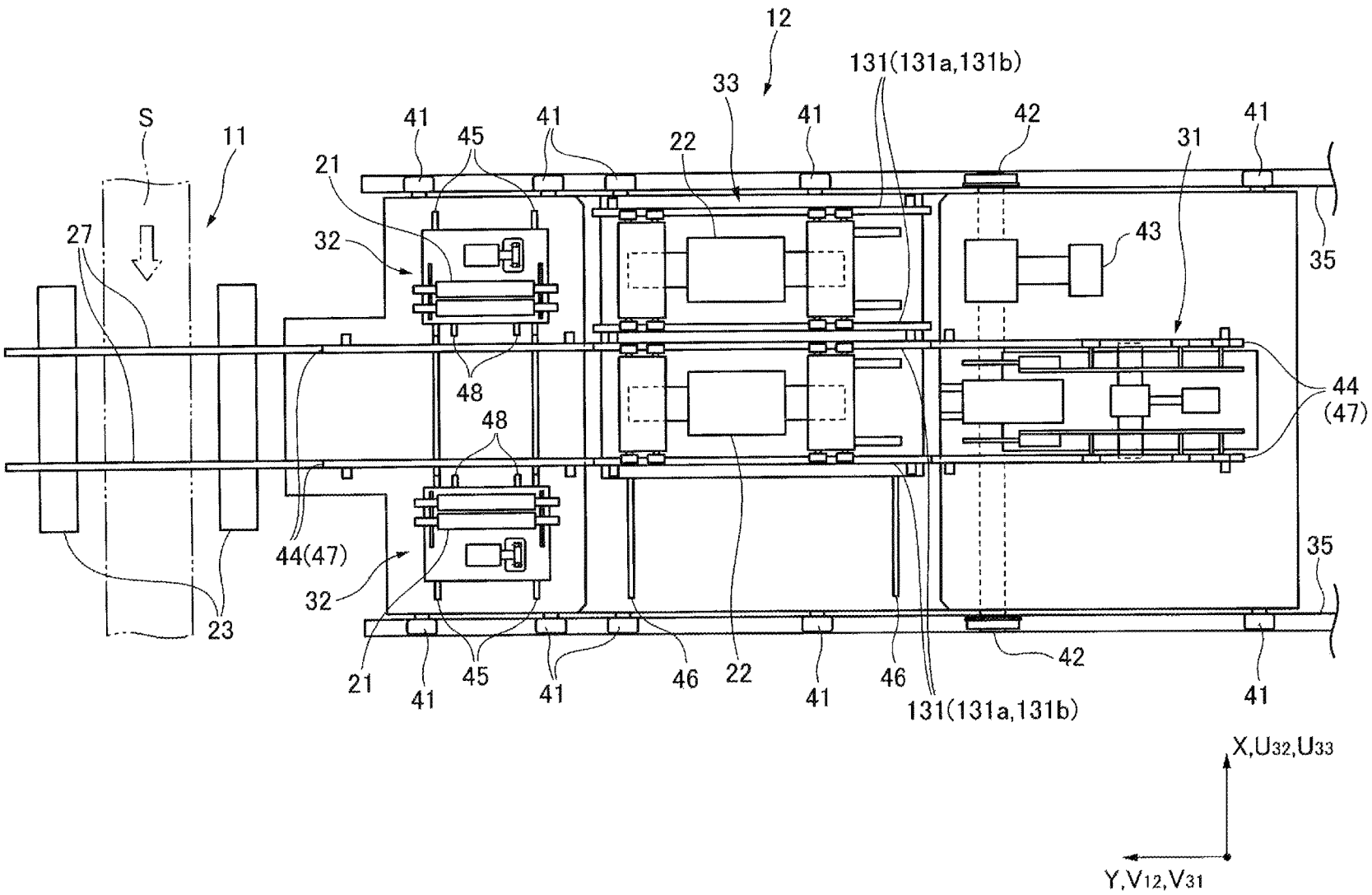
FIG. 3B is an explanatory drawing (corresponding to FIG. 1A) illustrating the back up roll change operation by the roll changing device according to Embodiment 1.

Next, the push puller device 31 is moved to the rear side of the apparatus, the one pair of top and bottom back up rolls 22 is delivered to and mounted on the back up roll transfer device 33, and the push puller device 31 is further moved and retracted to the rear side of the apparatus (see FIG. 3B).

Under this circumstance, the push puller device 31 is moved from the position adjacent to the rolling mill 11 to the rear side of the apparatus in the state where the one pair of top and bottom back up rolls 22 is held by the back up roll holding unit 52 (see FIG. 5A); and when the one pair of top and bottom back up rolls 22 is positioned at (or supported by) the rail part 131*a* of the rack member 131, the one pair of top and bottom back up rolls 22 can be mounted on the back up roll transfer device 33 by operating the latch drive unit 112 to release the engagement between the hook parts 111*a* of the latch swinging units 11 and the hook parts 29*a* of the latch members 29 (see FIG. 5B). However, in this state unlike the state illustrated in FIG. 5B, the top end faces 29*b* of the latch members 29 are not in contact with the contact faces 102*a* of the pressing mechanisms 102 in most cases.

Figure 3C:
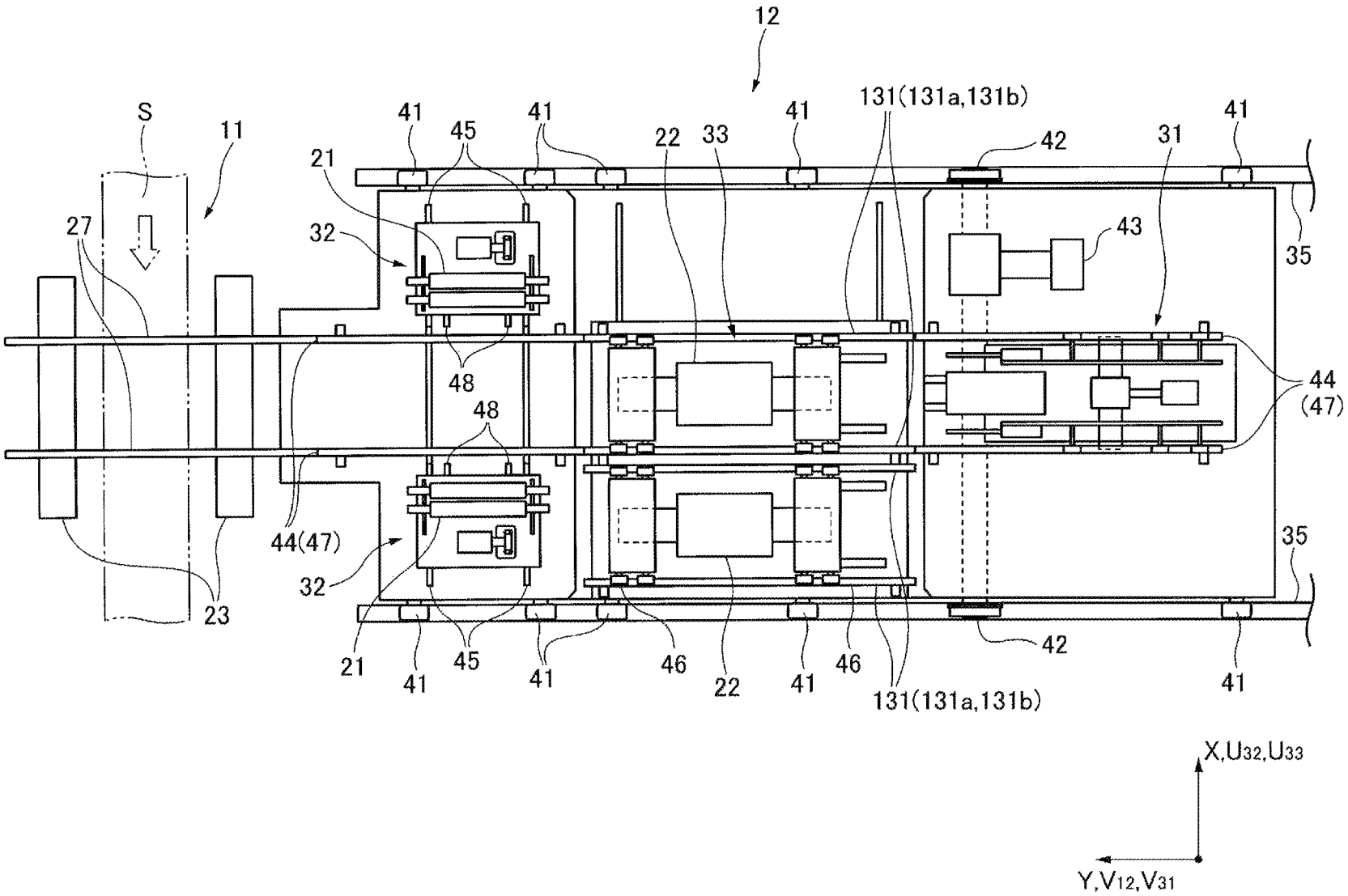
FIG. 3C is an explanatory drawing (corresponding to FIG. 1A) illustrating the back up roll change operation by the roll changing device according to Embodiment 1.

Next, the back up roll transfer device 33 is moved to cause a new one pair of back up rolls 22 positioned on the traveling path of the push puller device 31, thereby carrying the one pair of top and bottom back up rolls 22 into the rolling mill 11 (see FIG. 3C).

Figure 3D:
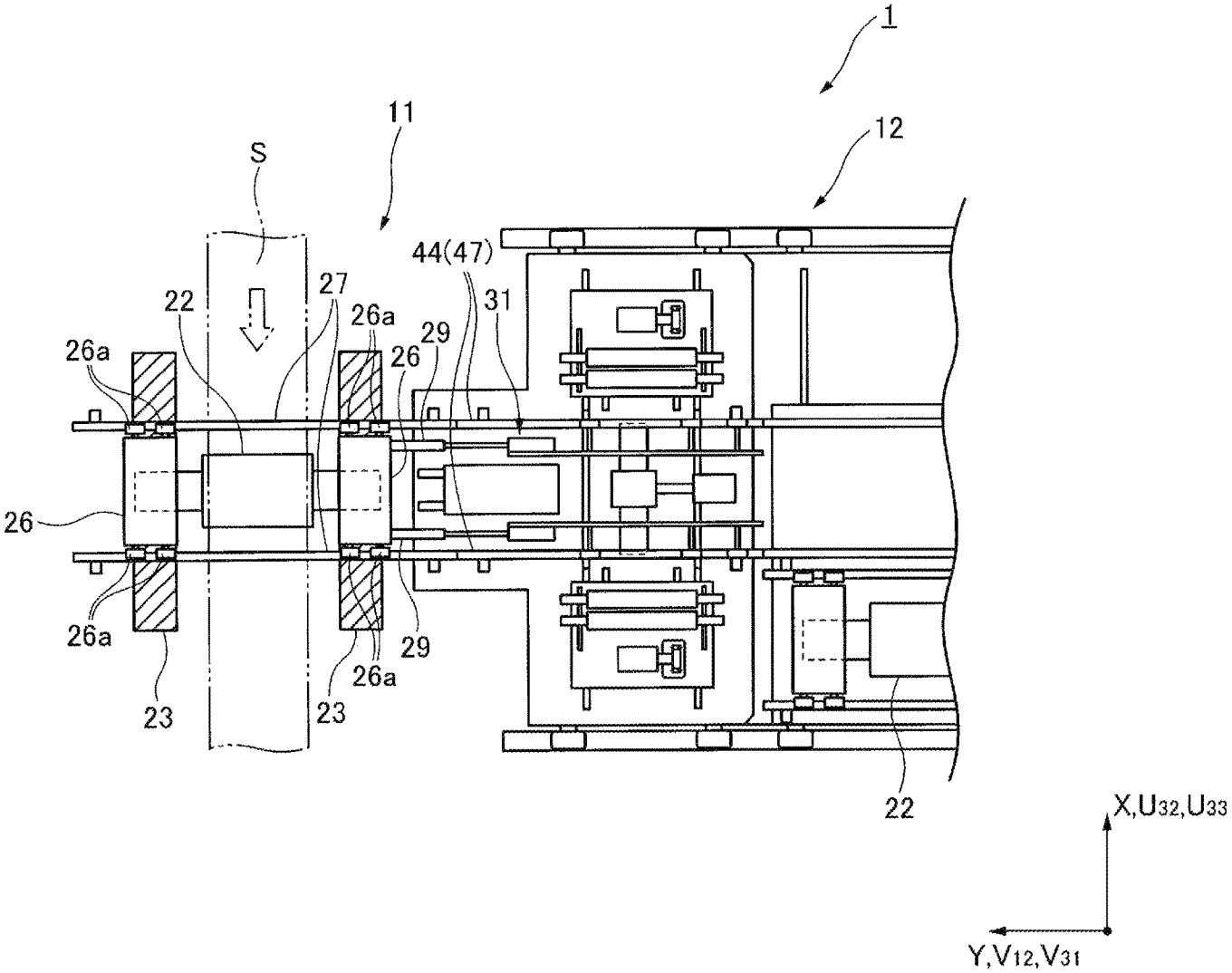
FIG. 3D is an explanatory drawing (a fragmentary detailed view of FIG. 1A) illustrating the back up roll change operation by the roll changing device according to Embodiment 1.

Subsequently, the push puller device 31 is moved to the front side of the apparatus to hold (or press) the one pair of back up rolls 22 mounted on the back up roll transfer device 33 and the push puller device 31 is further moved to the front side of the apparatus and positioned adjacent to the rolling mill 11, thereby carrying the one pair of back up rolls 22 into the rolling mill 11 (see FIG. 3D).

Under this circumstance, the new back up rolls 22 mounted on the other back up roll transfer device 33 at the top end faces 29*b* of the latch members 29 are in contact with the contact faces 102*a* of the pressing mechanisms 102, so that as the push puller device 31 is moved to the front side of the apparatus, the new back up rolls 22 are pushed and moved by that push puller device 31 and carried from the back up roll transfer device 33 into the rolling mill 11 (see FIG. 5B).

As a result, the one pair of used back up rolls 22 is carried out of the rolling mill 11 and the one pair of new back up rolls 22 is carried into the rolling mill 11, thereby completing the change of the one pair of top and bottom back up rolls 22.

According to the above-described procedure, the one pair of top and bottom back up rolls 22 in the rolling mill 11 can be changed, that is, the used back up rolls 22 can be carried outside and the pre-used back up rolls 22 can be carried inside by operating the push puller device 31.

Incidentally, when the back up rolls 22 are carried out of and into the rolling mill 11, the support rails 27, the first rails 44, and the rail parts 131*a* of the rack members 131 are connected to each other, so that the one pair of top and bottom back up rolls 22 and the push puller device 31 are designed to be moved smoothly.

INDUSTRIAL APPLICABILITY

The roll changing device according to the present invention is not limited to the case where it is applied to the rolling equipment equipped with the four-high rolling mill as in this embodiment; and the roll changing device according to the present invention may be applied to, for example, rolling equipment equipped with a six-high rolling mill. Accordingly, when the roll changing device according to the present invention is applied to the rolling equipment equipped with the six-high rolling mill, a pair of top and bottom work rolls (without any roll chock) can be changed at the same and a pair of top and bottom intermediate rolls (with roll chocks) for supporting these work rolls can be changed at the same by the roll changing device.

Moreover, the roll changing device according to the present invention is not limited to the case where it is applied to the rolling equipment equipped with one rolling mill as in this embodiment; and the roll changing device according to the present invention may be applied to, for example, a tandem rolling equipment equipped with a plurality of rolling mills. Accordingly, when the roll changing device according to the present invention is applied to the tandem rolling equipment, each of the plurality of rolling mills may include the roll changing device and the change of the rolls in the plurality of rolling mills may be enabled by the roll changing device by allowing the roll changing device (the device moving carriage) to have the configuration capable of moving in the threading direction.

REFERENCE SIGNS LIST

1 Rolling equipment
11 Rolling mill
12 Roll changing device
21 Work rolls
21*a* Shaft end
22 Back up rolls
23 Housing
23*a* Window
23*b* Opening/closing door
24 Support roller
25 Support jack (roll support device)
26 Roll chocks

26*a* Traveling rolls
27 Support rails
29 Latch members
29*a* Hook parts
29*b* Top end faces
31 Push puller device (roll holding device)
32 Work roll transfer device
33 Back up roll transfer device (second roll transfer device
34 Device moving carriage
35 Device moving rails
41 Traveling wheels
42 Drive wheels
43 Device moving motor
44 First rails
45 Second rails
46 Third rails
47 First rack gears
48 Second rack gears
51 Work roll holding unit
52 Back up roll holding unit (second roll holding unit)
53 Device body
54 Traveling wheels
55 Drive wheels
56 Drive unit
61 Holding mechanism
62 Rotating mechanism
63 Moving mechanism
71 Guiding parts
72 Movable body
72*a* Groove
73 Movable drive unit
81 Rotating shaft
82 Rotating body
83 Rotary drive unit
91 Flat plate part (support member)
92 Protrusions
93 Swinging units (clamp members)
94 Swinging drive unit (hydraulic cylinder)
101 Latching mechanisms
102 Pressing mechanisms
102*a* Contact faces
111 Latch swinging units
111*a* Hook parts
111*b* Rotation center shafts
112 Latch drive unit
113 Latch interlocking unit
121 Rack members
121*a* Notched grooves
122 Carrier
123 Traveling wheels
124 Drive gears
125 Drive motor
131 Rack members
131*a* Rail part
131*b* Rack gears
132 Carrier
133 Traveling wheels
134 Drive unit

The invention claimed is:

1. A roll changing device for changing a pair of top and bottom work rolls provided in a rolling mill for rolling a strip to be passed therethrough, the roll changing device comprising:

a work roll holding unit holding two pairs of work rolls including of top and bottom work rolls in an attachable/detachable manner at positions separated from each other in a threading direction and capable of moving the work rolls in the threading direction;

a roll holding device including the work roll holding unit and capable of moving in a roll axis direction relative to the rolling mill in a state of holding the work rolls by using the work roll holding unit; and a work roll transfer device capable of moving in a direction intersecting with a moving path of the roll holding device and capable of mounting the work rolls, wherein the roll holding device gives or receives the work rolls to or from the work roll transfer device which has moved to the moving path of the roll holding device.

2. The roll changing device according to claim 1, further comprising:

a second roll holding unit holding a pair of top and bottom back up rolls or a pair of top and bottom intermediate rolls provided in the rolling mill in an attachable/detachable manner; and a second roll transfer device capable of moving in a direction intersecting with the moving path of the roll holding device and capable of mounting the pair of top and bottom back up rolls or the pair of top and bottom intermediate rolls provided in the rolling mill, wherein the roll holding device includes the second roll holding unit and is capable of moving in the roll axis direction relative to the rolling mill in a state of holding the pair of top and bottom back up rolls or the pair of top and bottom intermediate rolls by using the second roll holding unit.

3. The roll changing device according to claim 2, wherein the roll holding device moves in the roll axis direction by using rails for moving the pair of top and bottom back up rolls or the pair of top and bottom intermediate rolls in the roll axis direction.

4. The roll changing device according to claim 2, wherein the second roll holding unit includes:

a latching mechanism engaging with the pair of top and bottom back up rolls or the pair of top and bottom intermediate rolls and carrying the back up rolls or the intermediate rolls out of the rolling mill by means of the movement of the roll holding device; and a pressing mechanism coming into contact with the pair of top and bottom back up rolls or the pair of top and bottom intermediate rolls and carrying the back up rolls or the intermediate rolls into the rolling mill by means of the movement of the roll holding device.

5. The roll changing device according to claim 2, further comprising a device moving carriage including, and capable of moving, each of the roll holding device, the work roll transfer device, and the second roll transfer device and capable of moving in the roll axis direction relative to the rolling mill.

6. The roll changing device according to claim 1, wherein the roll holding device includes a support member to be inserted between shaft ends of the pair of top and bottom work rolls and a clamp member for pressing each of the shaft ends of the pair of top and bottom work rolls against the support member;

wherein the support member can be inserted into contact with the shaft ends of the two pairs of work rolls; and wherein the clamp member presses each of the shaft ends of the two pairs of work rolls independently against the support member.

7. The roll changing device according to claim 6, wherein the clamp member includes two hydraulic cylinders independently capable of expansion and contraction.

8. The roll changing device according to claim 1, further comprising a roll support device maintaining the pair of top and bottom work rolls at a position capable of rolling within the rolling mill.

9. The roll changing device according to claim 1, wherein the roll holding device includes a rotating mechanism for rotating the work rolls held by the roll holding device around an axis parallel to the roll axis direction.

* * * * *